US008820068B2

(12) United States Patent
Dadd

(10) Patent No.: US 8,820,068 B2
(45) Date of Patent: Sep. 2, 2014

(54) LINEAR MULTI-CYLINDER STIRLING CYCLE MACHINE

(75) Inventor: Michael William Dadd, Oxford (GB)

(73) Assignee: ISIS Innovation Limited, Oxford (GB)

( * ) Notice: Subject to any disclaimer, the term of this patent is extended or adjusted under 35 U.S.C. 154(b) by 483 days.

(21) Appl. No.: 12/867,645

(22) PCT Filed: Feb. 17, 2009

(86) PCT No.: PCT/GB2009/000241

§ 371 (c)(1),
(2), (4) Date: Oct. 7, 2010

(87) PCT Pub. No.: WO2009/103943

PCT Pub. Date: Aug. 27, 2009

(65) Prior Publication Data

US 2011/0030367 A1 Feb. 10, 2011

(30) Foreign Application Priority Data

Feb. 19, 2008 (GB) ..... 0803021.5

(51) Int. Cl.
*F01B 29/10* (2006.01)
*F02G 1/05* (2006.01)
*F02G 1/043* (2006.01)

(52) U.S. Cl.
CPC ..... *F02G 1/0435* (2013.01); *F02G 2280/10* (2013.01); *F02G 1/05* (2013.01); *F02G 2244/50* (2013.01)
USPC ..... 60/517; 60/520; 60/525

(58) Field of Classification Search
USPC ..... 60/614, 520, 616, 517, 6; 236/46 R
See application file for complete search history.

(56) References Cited

U.S. PATENT DOCUMENTS 3,698,182 A * 10/1972 Knoos ..... 60/522
3,940,934 A 3/1976 Hakansson (Continued)

FOREIGN PATENT DOCUMENTS

DE 19530688 A1 2/1996
EP 1338785 A2 8/2003

(Continued)

OTHER PUBLICATIONS

5th International Energy Conversion Engineering Conference and Exhibit, Jun. 25-27, 2007. Multiphase Free-Piston Stirling Engine for Solar-Thermal-Electric Power Generation Applications. Artin Der Minassians and Seth R. Sanders. Power Electronics Research Group. University of California, Berkeley.

*Primary Examiner* — Thomas Denion
*Assistant Examiner* — Shafiq Mian
(74) *Attorney, Agent, or Firm* — Harness, Dickey & Pierce, P.L.C.

(57) ABSTRACT

A linear, multi-cylinder Stirling cycle machine comprises a plurality of Stirling cycle units arranged in an open series or closed loop. Each of the units comprises a compression space in fluid communication with an expansion space via a regenerative heat exchange assembly. The compression space and expansion space are in fluid communication with, respectively, a compression piston and an expansion piston, and the separate Stirling cycle units are mechanically coupled together by linear power transmitters, which connect the expansion piston of one unit to the compression unit of the other. The linear power transmitters can be linear transducers such as linear motors or generators. In the open series arrangement the series of Stirling cycle units can have an initiating compressor at one end and a terminating expander at the other end. hi the closed loop arrangement, one of the Stirling cycle units can include an exergy throttle to restrict gas flow rates to control the speed of the machine. The machine may be used in a combined heat and power apparatus with some Stirling cycle units acting as engine/generators and with waste heat being used for heating. Some Stirling cycle units can be used for cooling or heat pumping.

23 Claims, 16 Drawing Sheets

(56) References Cited

U.S. PATENT DOCUMENTS

| | | | | | |
|---|---|---|---|---|---|
| 3,996,745 | A | * | 12/1976 | Davoud et al. | 60/517 |
| 4,044,558 | A | * | 8/1977 | Benson | 60/520 |
| 4,121,423 | A | * | 10/1978 | Querry et al. | 60/616 |
| 4,161,866 | A | * | 7/1979 | Kamiyama | 60/517 |
| 4,199,945 | A | * | 4/1980 | Finkelstein | 60/520 |
| 4,214,447 | A | | 7/1980 | Barton | |
| 4,261,172 | A | | 4/1981 | Bratt et al. | |
| 4,330,994 | A | | 5/1982 | Rosenqvist | |
| 4,397,155 | A | * | 8/1983 | Davey | 62/6 |
| 4,498,298 | A | * | 2/1985 | Morgan | 60/525 |
| 4,532,855 | A | | 8/1985 | Meijer et al. | |
| 4,545,524 | A | * | 10/1985 | Zelczer | 236/46 R |
| 4,602,174 | A | * | 7/1986 | Redlich | 310/15 |
| 4,802,332 | A | | 2/1989 | Beale | |
| 4,888,951 | A | * | 12/1989 | Beale | 60/520 |
| 5,109,673 | A | * | 5/1992 | Vitale | 60/520 |
| 5,146,750 | A | * | 9/1992 | Moscrip | 60/517 |
| 5,172,784 | A | * | 12/1992 | Varela, Jr. | 180/65.245 |
| 5,303,555 | A | * | 4/1994 | Chrysler et al. | 62/6 |
| 5,394,700 | A | * | 3/1995 | Steele | 60/525 |
| 5,417,083 | A | | 5/1995 | Eber | |
| 5,456,076 | A | * | 10/1995 | Zornes | 60/525 |
| 5,615,556 | A | | 4/1997 | Honda et al. | |
| 6,094,912 | A | * | 8/2000 | Williford | 60/520 |
| 6,127,750 | A | | 10/2000 | Dadd | |
| 6,279,325 | B1 | * | 8/2001 | Sekiya et al. | 62/6 |
| 6,637,312 | B1 | | 10/2003 | Clucas et al. | |
| 6,877,314 | B2 | * | 4/2005 | Pels | 60/517 |
| 6,968,688 | B2 | * | 11/2005 | Gimsa | 60/526 |
| 7,043,925 | B2 | * | 5/2006 | Haberbusch | 62/6 |
| 7,134,279 | B2 | | 11/2006 | White et al. | |
| 7,171,811 | B1 | * | 2/2007 | Berchowitz et al. | 60/525 |
| 7,194,858 | B2 | * | 3/2007 | Ziph et al. | 60/525 |
| 7,247,957 | B2 | | 7/2007 | Dadd | |
| 7,891,184 | B2 | * | 2/2011 | Gimsa | 60/517 |
| 2001/0042373 | A1 | * | 11/2001 | Bliesner et al. | 60/517 |
| 2003/0160199 | A1 | | 8/2003 | Bareis et al. | |
| 2005/0029874 | A1 | | 2/2005 | Dadd | |
| 2005/0072148 | A1 | | 4/2005 | Francois et al. | |
| 2006/0048510 | A1 | | 3/2006 | White et al. | |
| 2007/0193266 | A1 | * | 8/2007 | McConaghy | 60/520 |
| 2008/0276615 | A1 | * | 11/2008 | Bennett | 60/614 |

FOREIGN PATENT DOCUMENTS

| | | | |
|---|---|---|---|
| GB | 2051961 | A | 1/1981 |
| GB | 2430238 | A | 3/2007 |
| JP | 57088255 | A | 6/1982 |
| JP | 2005036682 | A | 2/2005 |
| WO | WO-2007030021 | A1 | 3/2007 |

* cited by examiner

LINEAR MULTI-CYLINDER STIRLING CYCLE MACHINE

The present invention relates to Stirling cycle machines, e.g. engines and heat pumps, and in particular to linear multi-cylinder machines.

Stirling Cycle machines can be generally divided into two categories that are referred to as kinematic and linear (or Free Piston).

Kinematic Stirling machines have piston/cylinder assemblies in which the linear piston movement is converted to rotation e.g. by coupling it to a rotating shaft by a crank mechanism. This arrangement typically has a number of sliding surfaces that require some form of lubrication if rapid wear is to be avoided. Conventional oil lubricated crankshafts can be used but there is then a requirement to keep the oil from the heat exchangers to prevent contamination and loss of effectiveness.

Linear machines have evolved to avoid the requirement for lubrication. In such machines the piston is directly connected to a linear transducer and in principle there are no significant side forces that would require lubricated bearings. Linear motion for these machines is typically ensured by the use of flexures or gas bearings. Sealing is achieved through the application of established dry-running or clearance seal technologies. Such machines are also referred to as free-piston machines as the piston movement is not geometrically determined by a mechanism such as a crank, and this means that usually some measures have to be taken to control overstroke and piston offset.

Most large Stirling machines have been of the kinematic variety. This has enabled them to utilise conventional technology that has been highly developed in the field of internal combustion engines. However there is a major drawback in that the seals used to prevent oil reaching the heat exchangers have a limited life and need to be replaced at fairly frequent intervals (~10,000 hours).

Linear oil free machines have been demonstrated that have run for prolonged periods without deterioration. However economic manufacture of such machines in large quantities whilst retaining long life is yet to be achieved, but it is likely that designs will evolve that will be successful.

At present most linear machines are relatively small i.e. ~1 kW. Existing designs are primarily based on a single piston/displacer combination with the required phase angle between them achieved by using the pressure variation to drive the displacer pneumatically. These designs do not appear to scale very well to large sizes; they are inherently unbalanced and achieving the desired piston/displacer dynamics becomes more difficult as the stroke is increased.

An area of application where the Stirling engine has significant advantages is Combined Heat and Power (CHP or Cogeneration as it is also termed). Stirling engines are in principle capable of high efficiency, good reliability and long life—qualities that are important for this application. In addition they are external combustion engines that can more readily utilise less convenient but abundant energy sources such as biomass or solar radiation. There have been major investments in the development of Stirling Cycles for these applications but progress has been relatively slow. The main area open for exploitation appears to be in larger sized machines ~10 kW or greater, but the use of oil lubricated machines incurs the disadvantage of significant maintenance costs.

The extension of oil-free linear technology to larger multi-cylinder machines is a development that would significantly advance the application of Stirling cycle machines in this area.

Description of Stirling Cycle Machines

In the accompanying drawings FIG. 1 shows the basic components of a Stirling Cycle machine in what is known as an Alpha configuration. Practical machines are more often based on other configurations, termed Beta and Gamma, for reasons that will be presented later.

In this simplified version the Stirling cycle machine comprises:

- A first variable volume $V_1$ component at a temperature $T_1$ having a piston 1 in a cylinder 2 and attached to a first heat exchanger 3 also at $T_1$.
- A second variable volume $V_2$ component at a temperature $T_2$ having a piston 5 in cylinder 6 and attached to a second heat exchanger 7 also at $T_2$.
- A regenerator 9 situated between heat exchangers 3 and 7. The temperature of the regenerator 9 varies such that ideally there is a continuous temperature gradient ranging from $T_1$ at heat exchanger 3 and to $T_2$ at heat exchanger 7.
- The system is filled with a fluid and there is fluid connection between all the volumes.

Typically the pistons 1 and 5 reciprocate at a common frequency such that the variations of volumes $V_1$ and $V_2$ are sinusoidal. Depending on the phase and amplitude of the pistons 1 and 5, there will be a variation in pressure P in response to the overall changes in volume. For an ideal gas the pressure is given by:

$$P=m_T\cdot R/M\cdot 1/V_d/T_d+V_1(t)/T_1+V_2(t)/T_2$$

Where:

- $m_T$ is the total mass of gas
- R is gas constant and M is molecular mass of gas
- $V_d$ is the fixed volume, $T_d$ is an effective temperature for this volume
- $V_1(t)$ and $V_2(t)$ are the variable volumes given by:

$$V_1(t)=V_{1a}\cdot\mathrm{Sin}(\omega\cdot t)$$

$$V_2(t)=V_{2a}\cdot\mathrm{Sin}(\omega\cdot t-A)$$

Where A is the phase angle between the two variable volumes/pistons

The phase of the pressure variation will in general be different to the piston phases. For each piston it is possible to calculate by integration a value for the net work transferred from the piston to the gas by evaluating $\int P\cdot dV$ over a complete cycle. There are three cases depending on the phase between the two piston displacements. Two of these are where the pistons are in phase or anti-phase. These cases correspond to compression and displacement of the gas with no net work done by either piston. The case of interest is where the phase between the two pistons is between 0 and 180 degrees. Starting off with the volume variations in phase then neither piston transfers any net work to the gas. If we retard the phase of one piston we find that the motion of both pistons becomes out of phase with the pressure variation. For each piston there is now a net transfer of work between the gas and the piston. Furthermore it is found that irrespective of the values of $T_1$ and $T_2$, there is a net flow of work into the gas for the variable volume that is retarded and a net flow of work out of the gas for the other variable volume. This effect increases as the phase angle is increased to ~90 degrees and then decreases back to zero as the angle approaches 180. The two pistons/volumes can therefore be distinguished as a compressor piston supplying work into a compression volume and an expansion piston taking work out of an expansion volume. The net output of the system is the sum of the compressor and expansion work. Associated with these work transfers are heat flows in and out of the variable volumes and their heat exchangers. For an idealised Stirling cycle with a perfect regenerator the heat rejected from the compression side is equal to the compression work in and similarly the heat absorbed into the expansion side is equal to the expansion work. This is illustrated in FIG. 2.

Typically Stirling cycle machines operate with a phase angle of 90 degrees between the two pistons but the performance is not over-sensitive to phase angle and values in the range of 60 to 120 degrees are quite usable. Whether the system produces or absorbs power depends on the temperatures of the compression and expansion volumes and is determined by the second law of thermodynamics. This states that for reversible processes the change of entropy is given by $dS=dQ/T$. For a reversible cyclic process the net change in entropy must be zero. If we denote the compression temperature by $T_c$ and the expansion temperature by $T_e$ then: $dS=0$ hence $Q_c/T_c=Q_c/T_c=Q_e/T_e=W_e/T_e$ The three possible cases are:

$T_c<T_e$: The compression work is less than the work output of the expansion space so there is a net work output and the machine behaves as an engine. Heat $Q_e$ is absorbed at $T_e$ and $Q_c$ is rejected at $T_c$. Overall a quantity of heat $(Q_e-Q_c)$ is converted to work.

$T_c>T_e$: The compression work is greater than the work output of the expansion space so there is a net work input. The machine can be used to lift heat to a higher temperature as in a refrigerator or heat pump.

$T_c=T_e$: The compression work and expansion work are equal as are the quantities of heat rejected and absorbed. The only overall effect is that a phase angle is introduced between the enthalpy flow into the compression space and the enthalpy flow out of the expansion space.

In practice Stirling engines have almost always sought to provide a mechanism by which the expansion work and compression work are combined so that the only output of the machines is the net work done. This has the advantage of reducing the requirements of any mechanisms used to transfer power into or out of the machine—for an engine giving an electrical power output, a single lower rated generator could be used instead of a combination of a generator and motor. Combining the compression and expansion works has generally been achieved by adopting the Beta and Gamma configurations of the Stirling cycle machine. The Gamma configuration is illustrated in FIG. 3. In these machines the expansion piston is replaced by a displacer 11 that transmits the expansion work back into the compression volume V1. The work done on the remaining piston 1 is no longer just the compression work but also includes the expansion work and is thus the net work for the whole machine. A similar effect is achieved in a Beta configuration machine but in this case the piston and displacer are arranged to share the same cylinder.

An alternative to "re-circulating" the expansion work via a displacer 11 is to use the expansion work to provide the compression work for another Stirling cycle unit. This approach has not generally been exploited except for one important exception referred to as the Rinia configuration. This is illustrated in FIG. 4 where, for ease of visualisation, the Stirling cycle units have been unwound to give a two dimensional representation. There are four cylinders S1, S2, S3, S4 arranged in what is generally termed a "square" configuration and where each cylinder has a double acting piston P1, P2, P3, P4. The space above each piston P1 to P4 constitutes the expansion volume for one Stirling cycle unit and the space below each piston P1 to P4 piston constitutes the compression volume for the next Stirling cycle unit, with these two volumes being in fluid communication via a conventional heat exchange assembly including a heater H, cooler C and regenerator R. In FIG. 4 the space below piston P4 is connected to the cooler C1 of unit 1. There is a phase angle of 90 degrees between each neighbouring piston P1 to P4 and this allows a circular flow of work through the four sets of heat exchangers C1/R1/H1 to C4/R4/H4 with the required phase angle between compression and expansion spaces. Net power that is generated can be extracted from the pistons P1 to P4.

There have been three notable examples of the Rinia configuration developed in recent years. Whisper Tech have developed a Stirling engine that uses an oil-free wobble plate mechanism instead of cranks to extract power. This engine has been applied to both Marine applications and domestic Micro CHP and is described in U.S. Pat. No. 6,637,312 B1 and WO 2007/030021 A1.

The Infinia Corporation have patented a free piston version U.S. Pat. No. 7,134,279 B2. This is a Rinia engine similar to the Whisper Tech engine where double-acting pistons are used and the wobble plate has been replaced by four linear motor assemblies. The linear motor assemblies behave as mass spring systems and respond to the forces acting on the double acting piston as forced harmonic oscillators. The required phasing is achieved by specifying appropriate values for the mass/spring parameters. The double acting piston performs both compression and expansion, and so the compression and expansion sides share the same cylinder and have the same diameter. This configuration offers the advantage of a compact design but it has design constraints that become more disadvantageous as engine size is increased:

The piston and heat exchanger assemblies cannot be separately optimised as they are constrained to have approximately the same length Significant passageways are necessary to connect swept volumes to heat exchangers The piston shaft reduces the swept volume of one of the volumes. It is generally preferable to have the shaft and transducer assembly on the compression side as this avoids having to design around the high temperatures of the heater. The compression volume is therefore smaller than the expansion volume and the shaft size has to be chosen such that this difference is acceptable.

The use of a thermal buffer length between the expansion space and the piston may not be practical in this design because it would further constrain the length of the heat exchanger assembly.

The lengths of the double acting piston and shaft cause the centre of mass to be some distance from any support provided at the end of the shaft. In machines which are designed to operate with no contacting surfaces; lateral stiffness is an important requirement. In this cantilevered configuration the shaft size and the position of the centre of mass are constraints that may limit stiffness and hence operating frequency.

The compression and expansion volumes at either end of a piston clearly have to be 180 degrees out of phase and this determines that if the phase for a Stirling cycle unit is A then the phase between adjacent units is 180−A.

Global Cooling has patented a design U.S. Pat. No. 7,171,811 B1 that is similar to the Infinia concept, but has replaced the double acting pistons with stepped pistons. The main difference is that the phase relationship between adjacent units is different. This is due to the 180 degree difference between relative phases of a double acting piston compared with a stepped piston. Thus in the Global Cooling machine the phase angle between adjacent units is the same as the volume phase angle within each Stirling cycle unit.

In other respects the Global Cooling design has some of the constraints and disadvantages already detailed for the Infinia design. An advantage that the Global Cooling design does have over the Infinia design is the freedom to size the compression and expansion volumes independent of each other and the supporting shaft. An additional disadvantage is the requirement for two concentric sealing surfaces. This feature is certain to make greater demands on component accuracy and assembly techniques.

The present invention extends the idea of using the expansion work of one Stirling cycle unit to provide the compression work for another unit of a free-piston multi-cylinder machine, but this is achieved in a different way from the Rinia designs mentioned above, and avoids many of the constraints, particularly with regard to heat exchanger geometry.

According to the present invention there is provided a linear, multi-cylinder Stirling cycle machine comprising a plurality of Stirling cycle units, each of said units comprising a compression space in fluid communication with an expansion space via a heat exchange assembly, said compression space and expansion space also being in fluid communication with, respectively, a compression piston and an expansion piston, and wherein each unit is mechanically coupled to another unit by a linear power transmitter connecting the expansion piston of one unit to the compression piston of the other.

Thus, with the invention the expansion and compression pistons are distinct, separate, components at opposite ends of the linear power transmitter in contrast with certain prior art arrangements where a single component is used such as Infinia's double-acting piston or Global Cooling's stepped piston. This means that each pair of cylinders is connected by a different linear power transmitter. This contrasts with prior art multi-cylinder arrangements where cylinders are either not linked mechanically, or all cylinders are linked to the same mechanical assembly (e.g. a wobble plate or crank).

As will become clear, with the invention the phase difference between units (which is 180 degrees minus the Stirling Cycle phase angle) can be set as desired. A lower phase angle allows fewer units to be used while still balanced, but the phase angle also affects performance. For example, a Stirling Cycle phase angle of 60 degrees requires three units at 120 degree phase difference for balance. A Stirling Cycle phase angle of 90 degrees requires four units at 90 degree phase difference for balance. A Stirling Cycle phase angle of 108 degrees requires five units at 72 degree phase difference for balance. A Stirling Cycle phase angle of 120 degrees requires six units at 60 degree phase difference for balance. Some studies have shown that the best performance (compromise between power and efficiency) is achieved at about 120 degree Stirling Cycle phase. Thus, having a variable phase angle allows greater flexibility in achieving trade-offs between performance, complexity and balance. The invention is particularly applicable to high power machines, such as those with a power per Stirling Unit of 10 to 100 kW.

Preferably the axis of each connection between the heat exchange assembly and the compression and expansion spaces is substantially aligned with the axis of the respective compression or expansion piston. This has the advantage of ensuring uniform flows between the heat exchanger assembly and the compression or expansion spaces. Uniform flow helps to reduce irreversible mixing of different gas elements that would increase entropy and hence reduce overall efficiency. Another advantage is that the alignment helps to minimise the dead volume contained in the connection component—dead volume generally reduces performance.

In the closed loop arrangements there is clearly a requirement for changes in direction so that a circuit can be completed. In principle these changes of direction could be accommodated either within a heat exchanger component or in a connecting component and the choice is decided by evaluating the extra loss that would be incurred with a particular component. In most but not necessarily all applications, the heat transfer requirements for one of the heat exchangers results in an extended geometry that can accommodate a change of direction with little penalty. In these circumstances it is still advantageous for each connection between the heat exchange assembly and the compression and expansion spaces to be aligned with the axis of the respective compression or expansion piston The heat exchange assembly may comprise a series connection of a first heat exchanger, a regenerator and a second heat exchanger, and the first heat exchanger can be a low temperature heat exchanger such as a cooler and the second heat exchanger be a high temperature heat exchanger such as a heater. Preferably at least the regenerator and one of the heat exchangers has a cylindrical form, i.e. is not annular. The other heat exchanger may also have a cylindrical form in an open loop configuration (but in practice optionally not if it is a heater). For a closed loop embodiment one heat exchanger can be used to redirect the enthalpy flow so it will have cylindrical ends but a curve in between. In an engine the heater needs to have an extended surface to get sufficient heat transfer so it is easy to accommodate the change of direction Preferably the pistons are of the sliding or non-hermetic type using sealing rings or clearance seals to the cylinder walls forming the expansion or compression space. Hermetic types such as diaphragms, bellows or roll socks use flexing members that have limited stroke and a limited ability to withstand pressure differentials.

Thus in one preferred embodiment the gas seal between the pistons and cylinders is achieved by the use of contacting sealing rings. Preferably these sealing rings can operate for a long life without lubrication. In another preferred embodiment the gas seal between the pistons and cylinders is achieved by having a small enough clearance such that the leakage is acceptable. This allows the piston to operate without contacting the cylinder—such an arrangement is often termed a "clearance seal".

Preferably the expansion piston of one unit, linear power transmitter and compression piston of the next unit form a moving assembly constrained to move linearly. In preferred embodiments the compression and expansion pistons are rigidly attached to the linear power transmitter. This has the advantage of avoiding losses, complexity, expense and potential unreliability associated with linkages containing moving parts.

The linear power transmitter may be a linear power transducer. The power transducer may be adapted to receive a power input to the machine and the heat exchange assembly may then operate as a heat pump or cooler. Alternatively the heat exchange assembly absorbs heat and the linear power transducer outputs power from the machine.

The linear power transducer may be an electromechanical transducer such as a linear motor or generator.

The Stirling cycle units may be connected together in an open series configuration with a compressor initiator at one end connected to the compression space of the first unit in the series and an expander terminator at the other end connected to the expansion space of the last unit in the series. In this case the exciter compressor can control the operating frequency of the machine and also, by adjusting the amplitude of the oscillation, the power of the machine. Further, it is easy to stop the machine by stopping the exciter compressor. Stopping Stirling Cycle machines is a significant problem, especially at large sizes, as conventional methods of stopping, such as releasing gas pressure is difficult and dangerous in large machines, especially multi-cylinder ones, and obviously imposes the need to repressurise before restarting.

Preferably in this arrangement the Stirling cycle units are arranged coaxially to provide good balance.

Alternatively the Stirling cycle units may be connected together in a closed loop comprising three or more units with the expansion piston of each unit being connected to the compression piston of the next unit of the loop via said linear power transmitter. The Stirling cycle units may be disposed with their axes coplanar to provide good balance.

The invention allows the components of the Stirling Cycle units to be arranged with minimum use of connecting passages. Connecting passages generally reduce performance for a number of reasons: increased dead volume; pressure drop across connecting passage; and additional irreversible processes such as mixing and unwanted heat transfer. It is also worth noting that it is generally desirable to have uniform flows between the components to minimise these effects.

In the prior art there are significant connecting volumes, and the geometries make it difficult to achieve uniform flow conditions. In contrast the open-series embodiments of the invention allow the components to be assembled in line so that there is an absolute minimum of volume taken up with connecting passages. The simple cylindrical geometry also allows the flows between components to be kept very much more uniform.

For the closed loop embodiments the components cannot be all in line. However in practice changes of direction are easily accommodated within one of the heat exchangers. For example it is common in Stirling engines to have a heater which has an extended tubular construction. The required changes of direction can be achieved in the heater assembly without any additional connecting volumes.

Furthermore, in the prior art the heat exchanger assembly and the part of the pistons that has a temperature gradient across it have to be of approximately equal length. This forces a compromise between the individual optimisations of these components. The open inline geometry of open series-connected embodiments of the invention removes this constraint. The heat exchanger and piston design can be independently optimised.

In the closed loop arrangements an exergy throttle may be included in one or more of the Stirling cycle units to control the power of the machine. Such an exergy throttle may have an array of radially-extending fixed petals mutually spaced to allow fluid flow between them and arranged coaxially therewith an array of radially-extending spaced movable petals disposed such that axial rotation of the movable and fixed petals selectively varies the fluid flow space between the fixed petals. Exergy is the "available" energy, i.e. that energy which can be extracted as work. This depends not only on the total energy input to the system, but also the efficiency of the system. The exergy throttle can affect the fluid flow in the unit in two ways. At small reductions in the flow area it introduces irreversible processes such as flow friction and mixing which reduce efficiency. Larger restrictions significantly restrict fluid flow and so reduce exergy flow in the unit.

The compression and expansion spaces are preferably cylindrical.

The invention may be used in a combined heat and power apparatus comprising a linear, multi-cylinder Stirling cycle machine as above, at least one of said Stirling cycle units acting as an electricity generator, whereby heat supplied to said heat exchange assembly is used to produce electricity, and surplus heat is output for heating.

Further, one of said Stirling cycle units can act as a heat pump or cooler.

A significant advantage of the invention is the freedom that it allows in orienting the Stirling Cycle units. Thus, they can be arranged to achieve good balance and to position the hot and cold heat exchangers in convenient positions for the supply or rejection of heat, and to achieve good separation of the hot and cold parts of the machine.

The various advantages of the invention, in particular of minimising connecting passages and free optimisation and arrangement of components become greater as machines are scaled to large sizes. Thus the invention is particularly useful in applications to large-scale CHP where a power per Stirling Unit of 10 to 100 kW is envisaged (i.e. for a six unit engine the corresponding total power would be 60 to 600 kW).

The basic components of machines in accordance with the invention are:

1. A gas volume that has fluid connection with two other components. In general the gas volume will have a number of heat exchangers. In particular it can be designed for operation as part of a Stirling cycle and have a high temperature heat exchanger, a regenerator and a low temperature heat exchanger in series.
2. An exergy transmission/conversion device that consists of:
   a. A moving assembly that is constrained to have linear movement by sets of flexures or linear bearings.
   b. Piston/cylinder assemblies (usually provided with seals) at each end of the moving assemblies, preferably by rigid connections, each piston/cylinder volume having a fluid connection to a gas: volume as described in 1. The pistons may incorporate low thermal conduction extensions so as to give thermal isolation between the transmitter bodies and the compression or expansion spaces.
   c. The piston assemblies may also incorporate additional swept volumes for provision of gas springs. The extra swept volume may be formed by having a stepped piston or by adopting a double acting configuration. The pistons may have ports for pressure balancing and offset control.
   d. If it is required to exchange power with external devices then a linear transducer is incorporated, preferably by rigid connections, in the moving assembly. Such a transducer will typically generate electricity in generator mode or consume electricity in motor mode. A transducer may also export power in another form e.g. as a hydraulic pump.
3. A connecting component coupling a gas volume with a transmitter/transducer device. This may only constitute a short cylinder of minimum volume to give clearance for the pistons. More generally it may incorporate the following features:
   a. A thermal buffer length: This may be used to provide thermal isolation between a compression or expansion volume and a transmitter/transducer device.
   b. A variable volume: This may be used to adjust the total system volume so as to fine tune the transmitter dynamics.
   c. A throttle valve: This may be required in a self-sustaining engine to enable the output power to be controlled.

In designs that do not form a continuous loop additional components may be provided such as:

4. An exciter compressor for initiating the enthalpy flow into the first Stirling cycle unit.
5. A terminating component to absorb the final enthalpy output. Although this can be a separate component the transducer function required can be integrated into the final transmitter.
6. A linear balancer to correct any residual imbalance.

In the preferred embodiments the axes of the transmitters are coplanar to allow overall balancing.

In embodiments that do not form a continuous loop (i.e. require exciter compressor and terminating expander) at least two of the transmitters will be coaxial—otherwise they will not be easily balanced.

Another aspect of the invention provides a linear, multi-cylinder Stirling cycle machine comprising a plurality of Stirling cycle units connected together in an open series configuration with a compressor initiator at one end connected to a compression space of the first unit in the series and an expander terminator at the other end connected to an expansion space of the last unit in the series. Such an open-series configuration in a multi-cylinder machine is not known in the prior art.

With the open-series arrangement the exciter compressor can control the operating frequency of the machine and also, by adjusting the amplitude of its oscillation, the power of the machine. Further, it is easy to stop the machine by stopping the exciter compressor. Stopping Stirling Cycle machines is a significant problem, especially at large sizes, as conventional methods of stopping, such as releasing gas pressure is difficult and dangerous in large machines, especially multi-cylinder ones, and obviously imposes the need to repressurise before restarting.

The Stirling Cycle units in this aspect of the invention may use the preferred features of the other aspects of the embodiments of the invention discussed above and below, of course especially the open-series configurations. For example, each of the units may comprise a compression space in fluid communication with an expansion space via a heat exchange assembly, said compression space and expansion space also being in fluid communication with, respectively, a compression piston and an expansion piston, and each unit may be mechanically coupled to another unit by a linear power transmitter connecting, preferably rigidly, the expansion piston of one unit to the compression piston of the other. Preferably the axes of the connections between the heat exchange assemblies and compression and expansion spaces are substantially aligned with the piston axes, and preferably the pistons are of the sliding, non-diaphragm type using sealing rings or clearance seals.

The invention will be further described by way of examples with reference to the accompanying drawings in which:—

FIG. 1 schematically illustrates the basic components of an Alpha configuration Stirling cycle machine;

FIG. 2 schematically illustrates the work and heat flows for a Stirling cycle machine;

FIG. 3 schematically illustrates a Gamma configuration Stirling cycle machine;

FIG. 4 schematically illustrates the Rinia configuration Stirling cycle machine;

FIG. 5 schematically illustrates heat and workflows in a simplified Stirling cycle component used in an embodiment of the invention;

FIG. 6 schematically illustrates a linear power transmitter component used in an embodiment of the invention;

FIG. 7 symbolically illustrates the workflows in the power transmitter component of FIG. 6;

FIG. 8 schematically illustrates a sequence of Stirling cycle component and power transmitter components forming part of a Stirling cycle machine in accordance with an embodiment of the invention;

FIG. 9 is a diagram for analysis of forces acting in the power transmitter unit of an embodiment of the invention;

FIG. 10 schematically illustrates a linear piston transducer unit, which can be used either as an initiating compressor or terminating expander in one embodiment of the invention;

FIG. 11 schematically illustrates the use of an initiating compressor and terminating expander in an embodiment of the invention;

FIG. 12 schematically illustrates an alternative integrated form of terminating expander;

FIG. 13 illustrates a closed loop arrangement of Stirling cycle unit in accordance with another embodiment of the invention;

FIG. 14 schematically illustrates an open-series of Stirling cycle units forming a Stirling engine in accordance with an embodiment of the invention;

FIG. 15 schematically illustrates one Stirling cycle unit of a hexagonal three phase Stirling cycle machine according to an embodiment of the invention;

FIG. 16 schematically illustrates a throttle arrangement used in one embodiment of the invention;

FIGS. 17 (A) and (B) illustrate the throttle arrangement of FIG. 16 in side view;

FIG. 18 illustrates an embodiment of the invention in which engine and heat pump units are combined in an embodiment of the invention;

FIG. 19 schematically illustrates the use of double-acting and stepped pistons to provide additional gas springs in an embodiment of the invention;

FIG. 20 schematically illustrates a modular construction for a Stirling machine in accordance with an embodiment of the invention;

STIRLING CYCLE COMPONENT

Figure 1:
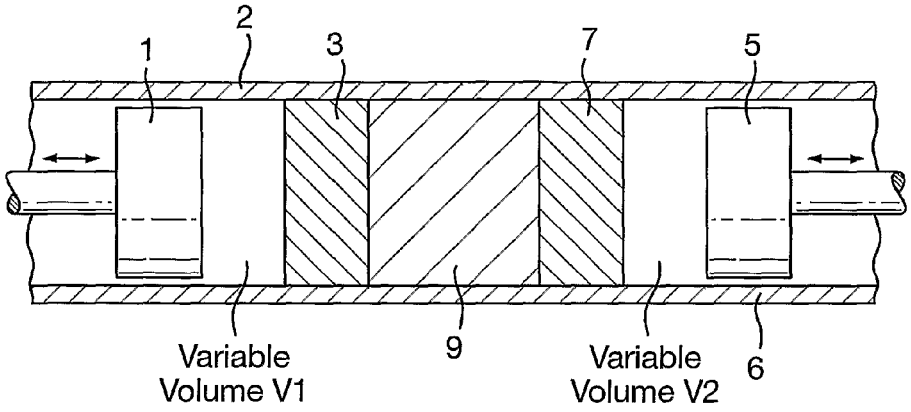
Figure 2:
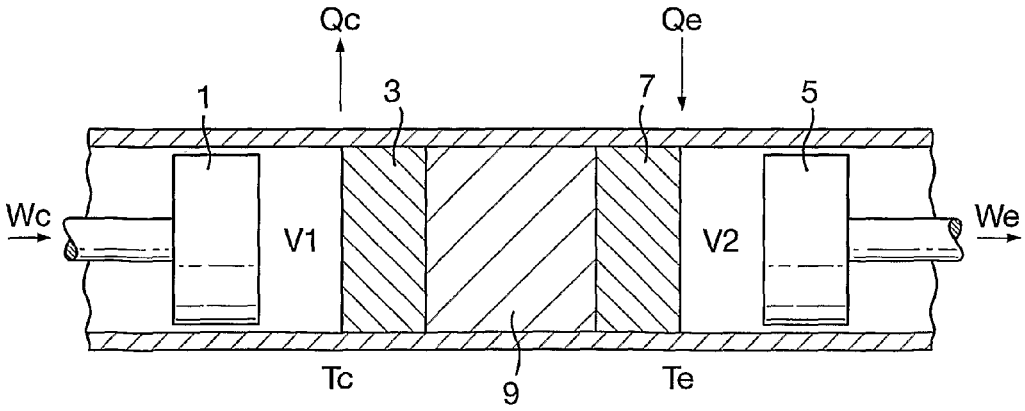
Figure 3:
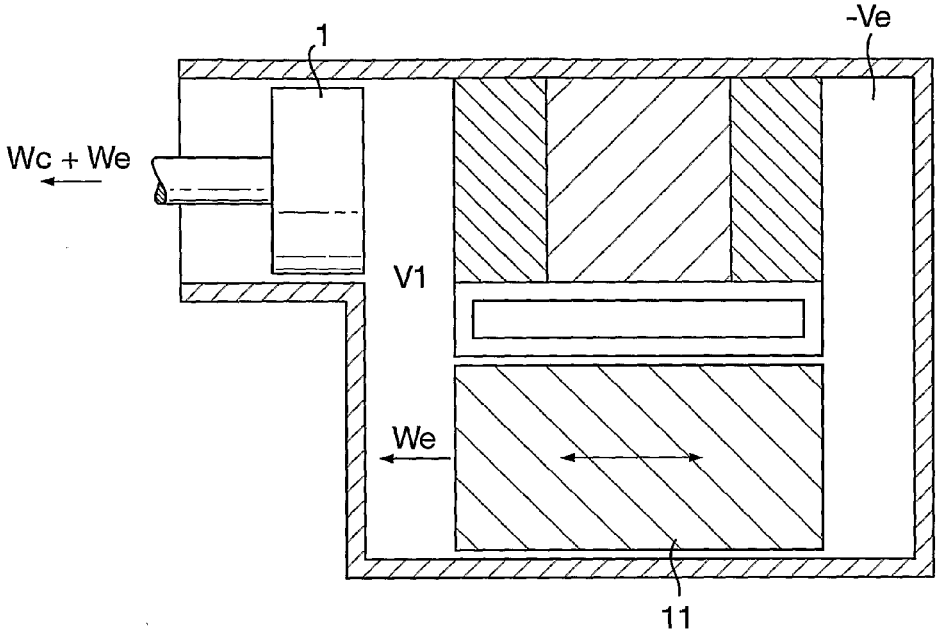
Figure 4:
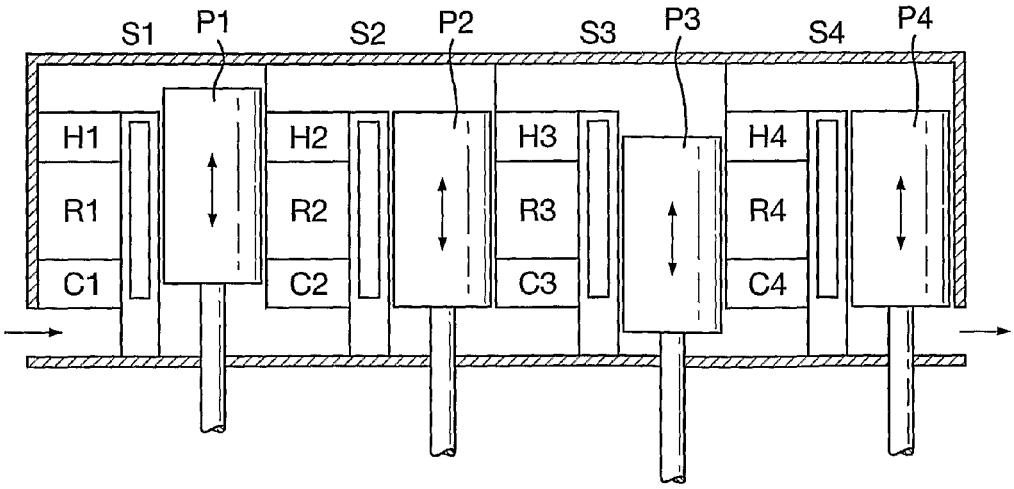
Figure 5:
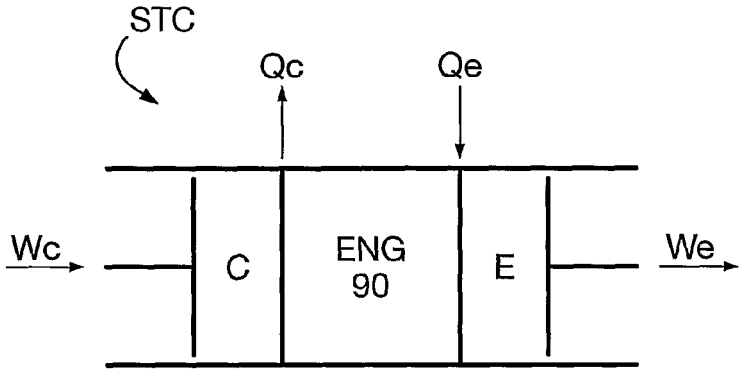

FIG. 5 shows a simplified representation of a Stirling cycle component as used in an embodiment of the invention. The compression and expansion volumes with their pistons are represent by C and E respectively. The middle component constitutes a fluid volume connected to the compression and expansion volumes and will generally contain heat exchangers. The relative temperatures of the heat exchangers determine the ratio of power leaving the expansion space E to the power entering the compression space C. This ratio can be regarded as an amplification factor $\alpha$ and there are three different modes of operation according to its value. These will be denoted in the drawings with labels "ENG", "PS" or "HP" for the heat exchanger assembly, with the meaning given below:

ENG: $\alpha>1$, $T_c<T_e$: a Stirling unit that is developing power and acting as an engine PS: $\alpha=1$, $T_c=T_e$: a Stirling unit that has unity gain and acts as a Phase Shifter HP: $\alpha<1$, $>T_e$: a Stirling unit that is absorbing power and acting as a heat pump (or refrigerator)

The phase angle between compression and expansion spaces is also indicated by including its value (e.g. 90). The heat and work flows are indicated by the arrows.

Thus in FIG. 5 the middle component is denoted as ENG90, for example, which would indicate that this unit is set up to operate as part of an engine with a phase difference of 90 degrees between the volumes and pressures of the compression and expansion spaces.

Linear Power Transmission/Conversion Component

Figure 6:
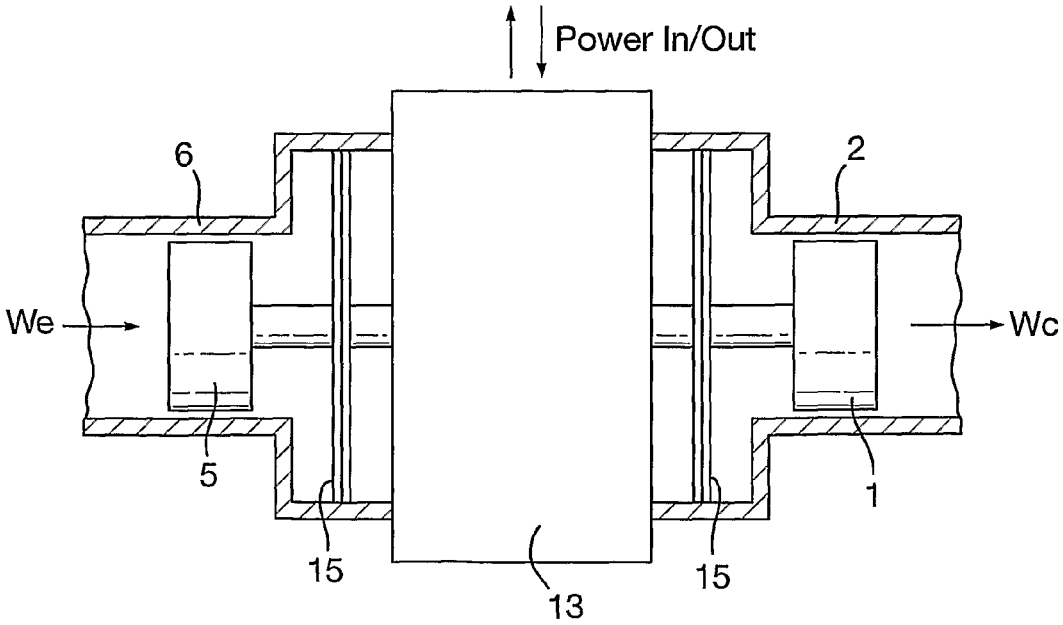

The other main component required in embodiments of the invention is shown in FIG. 6. It can be described as a linear power transmission/conversion component. It consists of a moving assembly that is constrained to have a linear movement by the use of linear bearings or flexures 15. The moving assembly has two pistons 1 and 5, one attached rigidly at each end and engaged in corresponding cylinders 2 and 6 sealing to the cylinder wall with a clearance seal or sealing rings. Both pistons act on the fluid that fills the system. In the middle of the moving assembly is attached a linear power transmitter 13 that is able to transmit power to the next piston and can act as a transducer to input or output power to and from the device. Thus, in general terms, the mode of operation is that an enthalpy flow (i.e. power) is absorbed from the fluid at the face of one piston 5 and is mechanically transmitted to the face of the other piston 1 where it is radiated back into the fluid. The transducer 13 also allows power transfer between the device and the external world so that the radiated power can be greater or less than the incident acoustic power.

Figure 7:
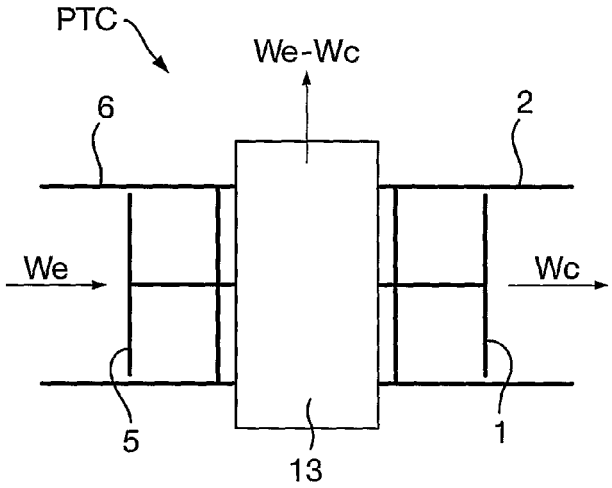

FIG. 7 shows a simplified representation of the linear power transmission/conversion component. The arrows next to the pistons 1 and 5 show the direction of energy flows into and out of the pistons. The operation of the device is indicated by an arrow and the letter within the power transmitter 13, and, as above, there are three modes:

- G: (as illustrated in FIG. 7) The power transmitter 13 is a transducer operating as a generator extracting a power output from the system
- M: The power transmitter 13 is a transducer operating as a motor delivering a power input into the system
- TO: (Transmission Only) The power transmitter 13 is neither delivering nor extracting power and the device is only transmitting power from one piston to the other.

Combining the Components to Form a Stirling Machine

The two components described are both different types of energy conversion devices. The Stirling cycle component of FIG. 5 converts thermal energy to flow work in the fluid and vice versa. The linear power transmission/conversion component of FIG. 6 transmits flow work whilst also being able to convert it to power (e.g. electric power) that can be transferred to or from the device. If these two types of component are combined then it is possible to build up a sequence of units such that the thermal energy conversion in the Stirling cycle processes is balanced by appropriate power inputs and outputs in the linear power transmission/conversion components.

Figure 8:
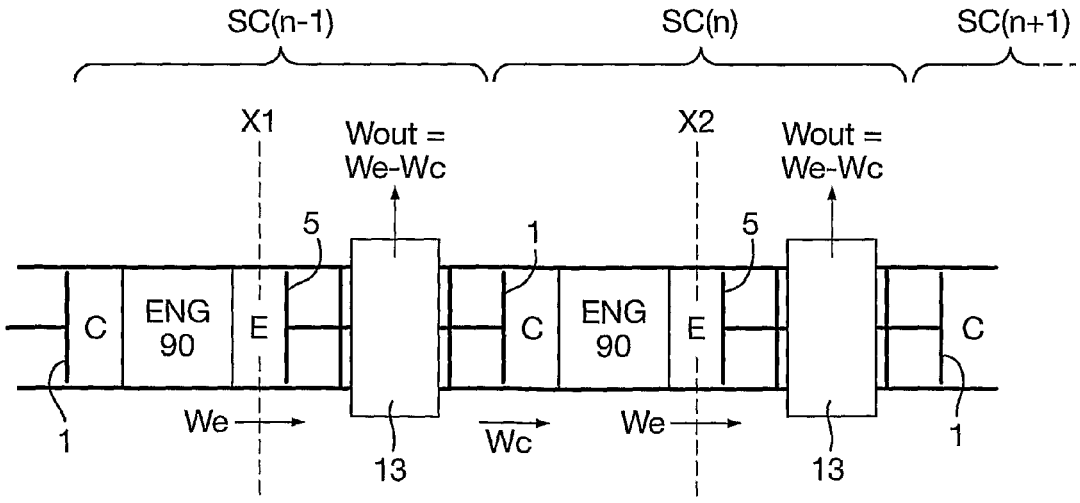

As an example FIG. 8 shows how a sequence of units, each having a Stirling cycle component and a power transmission component, can be combined to form a type of Stirling engine. At X1 there is power $W_e$ flowing from the expansion space of the Stirling cycle unit SC(n−1). This power is absorbed by the power transmitter 13 acting here as a generator and a quantity of power $W_{out}$ is converted to electrical power. The remaining power $W_c$ (where $W_c=W_e-W_{out}$) is transferred back into the gas via the compression piston 1 where it becomes the compression power for the next Stirling cycle unit SC(n). This Stirling cycle unit uses the compressor power and heat absorbed in heat exchange assembly ENG90 to drive a thermodynamic cycle that generates a power output of $W_e$ and so on.

It is clear that any number of Stirling cycle components and power transmission components can be coupled together in a chain like this to build larger machines. It is noted that the transmission component adds a phase of 180 degrees by virtue of having pistons at opposite ends—i.e. successive expansion space pistons will have a phase difference of 180−A.

In practice it is necessary that:

- the power transmitters 13 operate so as to give the necessary phase angle between the compression and expansion volumes; and
- a mechanism is provided for initiating and terminating the enthalpy flows at the beginning and end of the chain.

Obtaining Required Phase Angle

The phase angle between succeeding piston/transmitter assemblies must be that required for the Stirling cycle process to operate. This will be explained below although it is known to the person skilled in the art as it is required in free piston machines such as those disclosed in U.S. Pat. No. 7,134,279 B2 and U.S. Pat. No. 7,171,811 B1.

The phase angle of a transmitter device is determined by its response to the net force acting. The moving assembly of the transmitter device together with the effective spring rate supplied by flexures 15 etc constitute a mass/spring system or harmonic oscillator.

In order to analyse the behaviour of a single transmitter we can begin by assuming that it is part of an infinite series (in similar way that ladder filters can be analysed in electronics).

Figure 9:
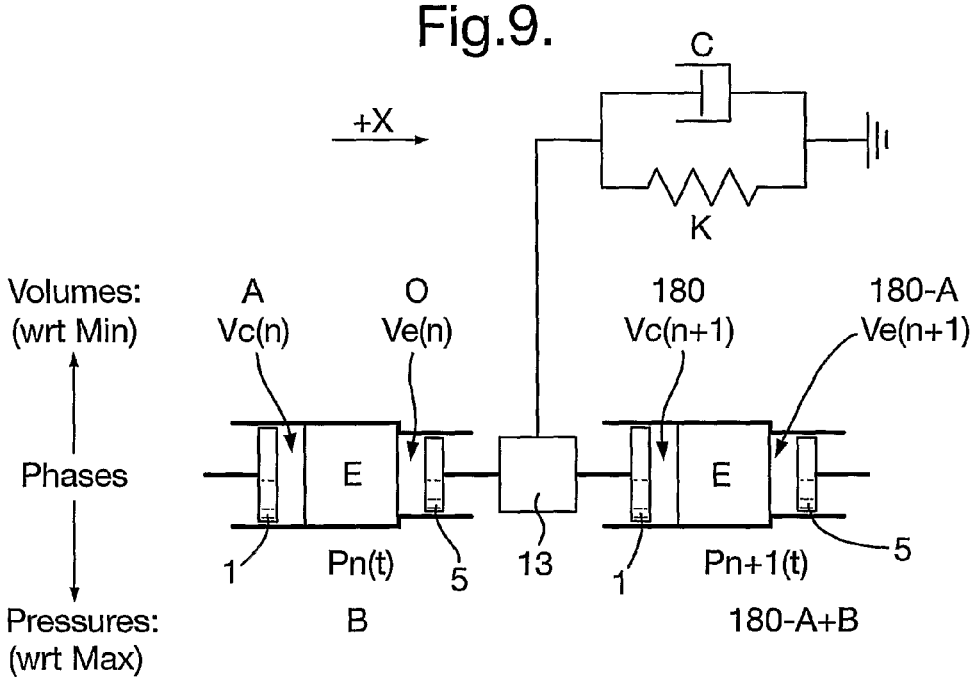

FIG. 9 shows a section consisting of a power transmitter 13 between two Stirling cycle heat exchanger units E. The piston 5 at one end of the transmitter 13 acts on the expansion volume Ve(n) and is subject to pressure variation $P_n(t)$. The piston 1 at the other end acts on the compression volume Vc(n+1) and is subject to pressure variation $P_{n+1}(t)$. The net force produced by these pressures drives the moving mass M of the transmitter 13. The response of the transmitter 13 can be found by treating it as a damped harmonic oscillator with components:

- Mass M: The moving mass of the transmitter assembly
- Spring rate K: The spring rate of the flexures 15 and any additional springs.
- Damping Coefficient C: The damping force will be assumed to be the force generated by an attached transducer. If the power flow is into the transmitter 13 from the outside then the damping coefficient is effectively negative.

The desired phases of the compression and expansion volumes are also shown in FIG. 9. If it is assumed that phase angle θ=0 corresponds to the minimum volume of Ve(n) and that the phase angle between compression and expansion is A, then the phases of the other volumes are as follows:

Min Ve(n): phase angle θ=0
Min Vc(n): phase angle θ=A
Min Vc(n+1): phase angle θ=180
Min Ve(n+1): phase angle θ=180−A It will be seen that the phase angle between successive units is 180−A. For A=90 the phase angle is 90 degrees for A=60 the phase angle is 120 degrees The pressure variation for the units is given by $$P(t)=m_T\cdot R/M\cdot 1/V_d/T_d+Z_e\cdot \mathrm{Sin}(\omega t)+Z_c\cdot \mathrm{Sin}(\omega T-A)$$

Where $$Z_e=V_{ed}/T_e$$

and $$Z_c=V_{cd}/T_c$$

$V_{ea}$ and $V_{ca}$ are the volume amplitudes

It will be seen that the maximum pressure occurs between the points of minimum compression and expansion volume so that pressure phases are:

Max $P_n(t)$: phase angle θ=B
Max $P_{n+1}(t)$: phase angle θ=180−A+B

B is determined by the relative values of $Z_e$ and $Z_c$ but is confined to the range A>B>0

Although the actual pressure variation is not strictly sinusoidal it can be reasonably represented by:

$$P_n(t)=P_a\cdot\mathrm{Sin}(\omega t-B)$$

$$P_{n+1}(t)=P_a\cdot\mathrm{Sin}(\omega t-(180-A+B))$$

The total force acting on the moving mass of the transmitter 13 in the +X direction is given by:

$$F_T=P_n(t)\cdot A_{Pe}-P_{n+1}(t)\cdot A_{Pc}$$

Where $A_{Pe}$ and $A_{Pc}$ are the areas of the expansion and compression pistons 1 and 5.

It will be initially assumed that the expansion and compression pistons 1 and 5 are equal in diameter i.e. $A_{Pe}=A_{Pc}$ The total force can then be expressed as:

$$F_T=A_p\cdot P_a(\mathrm{Sin}(\omega t-B)-\mathrm{Sin}(\omega t-(180-A+B)))$$

The subtraction of 180 degrees from the second term reverses its phase so that it is now positive:

$$F_T=A_p\cdot P_a(\mathrm{Sin}(\omega t-B)+\mathrm{Sin}(\omega t-(B-A)))$$

Further simplification leads to $$F_T=A_p\cdot P_a\cdot G\cdot\mathrm{Sin}(\omega t-(B-A/2))$$

where $$G=2\cdot\mathrm{Cos}(A/2)$$

The net force acting on the moving mass M of transmitter 13 therefore has a phase angle θ=B−A/2

For a harmonic oscillator the phase C between the driving force and the displacement can be between 0 and 180 degrees depending on the ratio of the drive frequency to the resonant frequency of the oscillator:

For $\omega/\omega_r<1$ C tends to 0

For $\omega/\omega_r\sim1$ C is ~90 degrees

For $\omega/\omega_r>1$ C tends to 180 degrees

It is now possible to assess how to set the dynamics of the transmitter 13 so as to obtain the required response. The movement of the transmitter 13 is in phase with expansion volume Ve(n) so the required phase angle for maximum displacement is 180 degrees:

Min Ve(n): phase angle θ=0

Max Ve(n)=Max X: phase angle θ=180

The phase angle C required can therefore be calculated from:

$$C+B-A/2=180$$

or $$C=180-(B-A/2)$$

It will be seen that for this arrangement to work the pressure phase angle B must be greater than A/2. This condition is generally achieved by ensuring that the peak pressure is reasonably close to the minimum compression volume. This requires that:

$$V_{ca}/T_c>V_{ea}/T_e$$

As the diameters of pistons 1 and 5 have been assumed to be equal and the strokes are necessarily equal then the condition requires that the expansion temperature must be higher than the compression temperature. This condition is clearly fulfilled for engines but not for heat pumps or coolers.

For an engine operating with $T_e$=1000K and $T_c$=300K and phases of 60 and 90 deg typical values might be:

A=60, B~50 C~160 A=90, B~75 C~150

The operating frequency will therefore be higher than the resonant frequency of the mass spring system as defined. Also the frequency will tend to be higher for A=60 compared with A=90.

If the piston diameters are allowed to be different then the requirement for correct phasing can be met by increasing the ratio of compressor piston diameter to expansion piston diameter. It is therefore possible for this arrangement to work for heat pumps and coolers providing the pistons' diameters are sized correctly.

Initiating and Terminating the Series

The analysis above has concerned itself with the operation of the Stirling/Transmitter component combinations in an infinite series i.e. once the enthalpy flow into and out of the machine has been established. For practical machines the series will be finite and some means is required for initiating and terminating the series. In general there are two possible ways of achieving this:

- the provision of separate initiating and terminating devices; and
- a self sustained arrangement where the ends of the series are connected to form a continuous loop.

Separate Initiating and Terminating Devices

Initiation is easily provided by a single linear compressor used as an exciter which is driven by an external power source. For efficient operation it is only necessary that it is driven at resonance by matching the moving mass to the spring rate. The details of such a compressor are conventional and are familiar to those skilled in the art.

Figure 10:
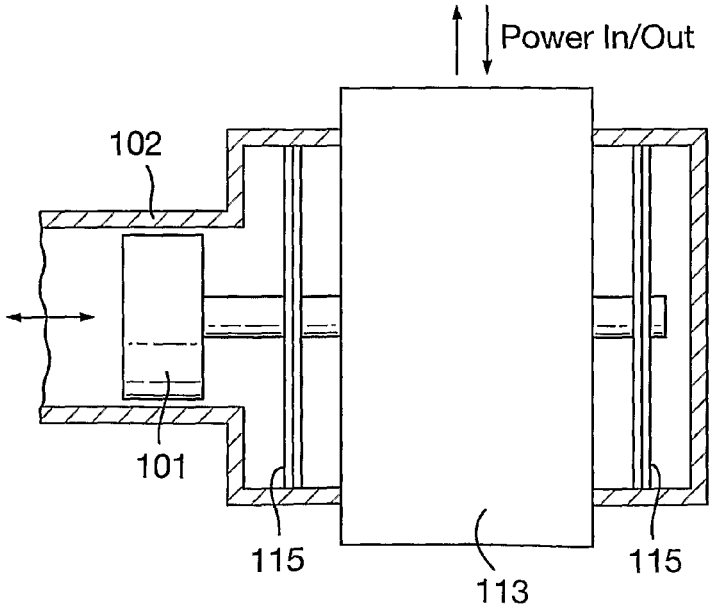

The terminating device can be an expander that absorbs the enthalpy flow and preferably outputs it as useful power. This is very similar to the initiating compressor and again is familiar to those skilled in the art. A typical arrangement for a terminating expander or initiating (or exciting) compressor is shown in FIG. 10. It has a piston 101 which reciprocates in a cylinder 102 and is connected to a transducer 113, the moving assembly including the piston being supported for linear motion by flexures 115. When used as an exciter/initiator power is supplied from the outside to the transducer 113 which drives the piston 101 to provide compression to the first Stirling cycle component of the series. When used as a terminator the piston 101 absorbs the expansion power from the expansion space of the last Stirling cycle unit of the series and the transducer outputs this as useful power.

Figure 11:
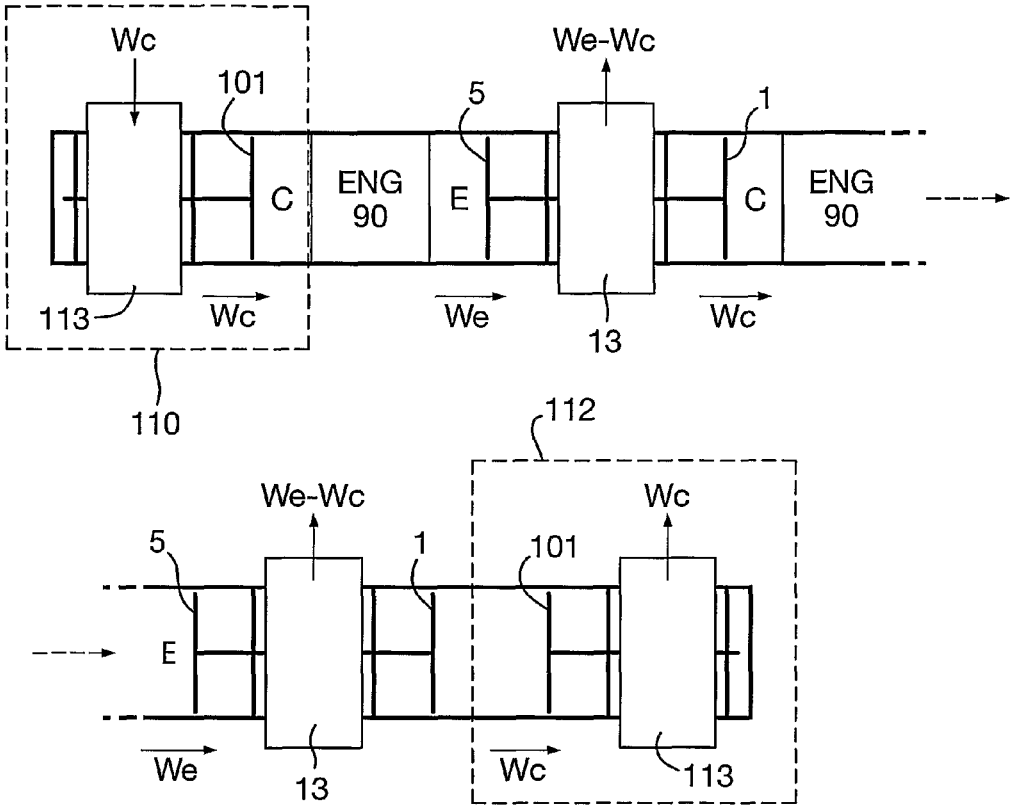
Figure 12:
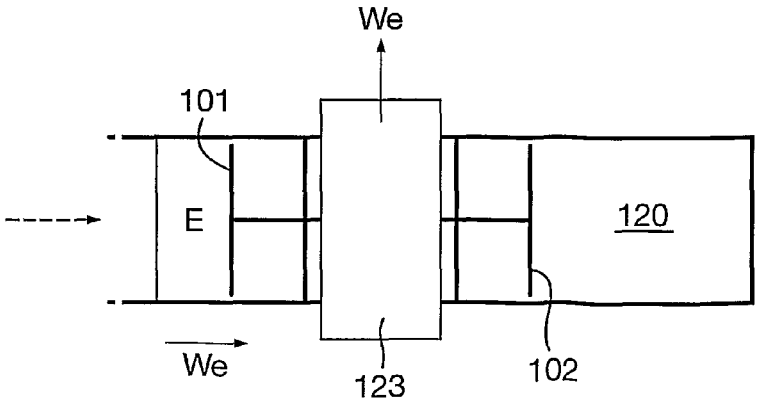

The use of an "exciter" compressor 110 and "terminating" expander 112 is shown in FIG. 11. The terminating expander 112 is shown as a unit that is driven by a fluid connection with the compression piston 1 of the last transmitter 13. The expander 112 must present an equivalent impedance to the compressor piston 1 as would be experienced in the rest of the sequence but this a matter of adjusting the spring and damping components of the expander 112 appropriately. The components of the final transmitter 13 and expander 112 can be integrated into a single generator/expander unit 123 with a gas spring 120 as is shown in FIG. 12. The gas spring volume 120 is used to provide the necessary spring component acting on the last transmitter 13 via piston 102.

If the exciter and terminator devices were 100% efficient, then in principle with necessary phase adjustment the total power input to the initiating compressor 110 could be supplied by the terminating expander 112. In practice a significant part of the initiating compressor power may be supplied in this way, but not all, so there will generally be a requirement for power input to the initiating compressor 110 in addition to the power generated in the terminating expander 112. Where the series of Stirling cycle units is operating as an engine this will come from power developed by the transducers incorporated in the linear power transmitters 13.

A significant advantage of this arrangement is that in engine applications the power output can be directly and efficiently modulated by controlling the power into the initiating compressor 110. If the power into the initiating compressor 110 is reduced then the powerflow through all the other Stirling cycle and power transmitter components will also be reduced. With no power into the exciter compressor 110 there will be no power flow at all and the engine will be stopped.

Continuous Loop Arrangements

Figure 13:
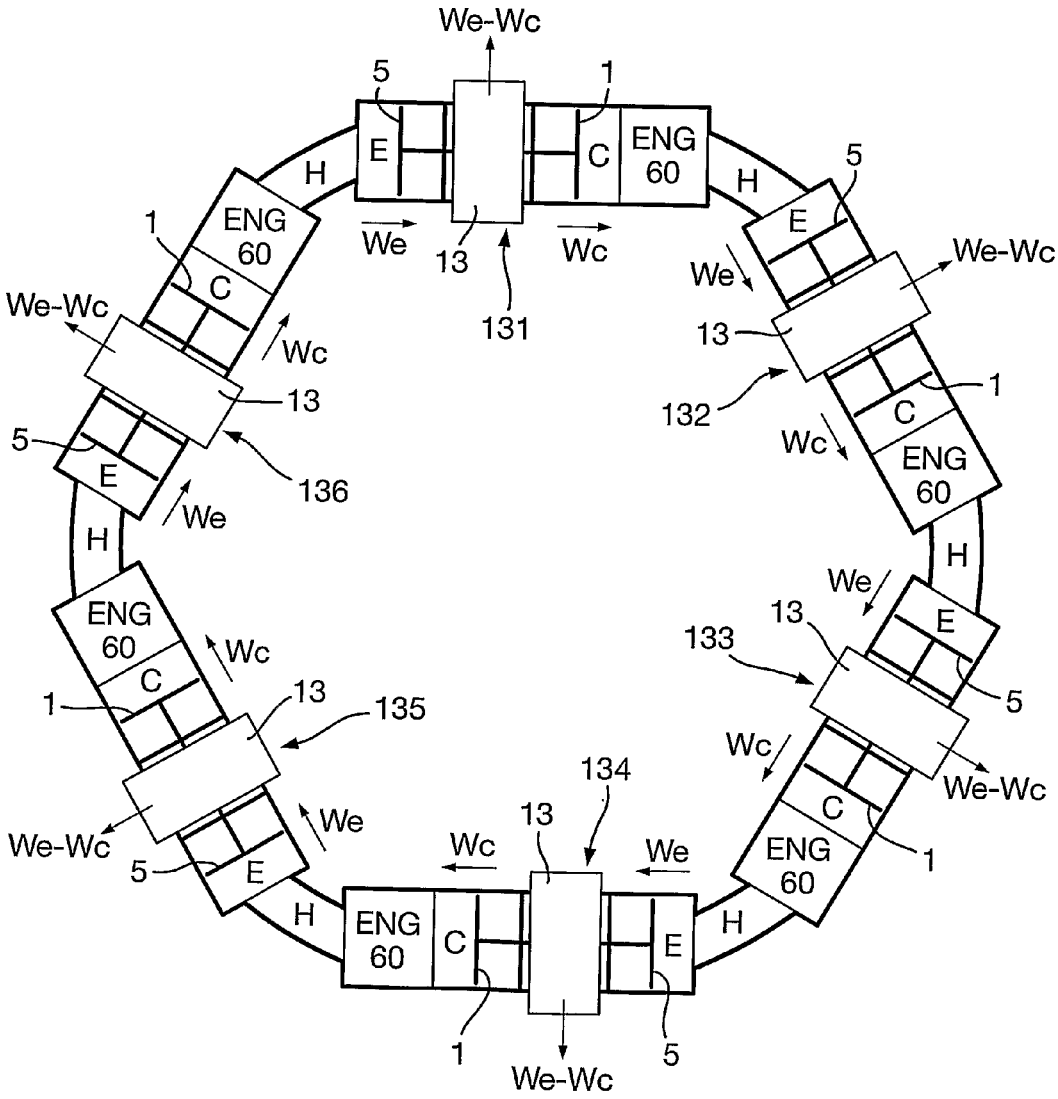

If the sequence of Stirling cycle and transmitter components is arranged in a loop it can be seen that provided the total phase change around the loop is a multiple of a then there is a continuous process of an expansion volume providing the work for the next compression volume. The extra initiating and terminator components 110 and 112 are not required. Such an arrangement is shown in FIG. 13 where there are six units 131 to 136, each having an expansion piston 5, linear power transmitter 13, such as a linear moving coil or moving magnet electromagnetic transducer outputting electrical power, and a compression piston 1 for the next Stirling cycle component. The six units 131 to 136 are conveniently coupled by heater tubes H which receive heat, e.g. by burning fuel. The heater tubes H fluidly couple the expansion space E and, via a regenerative heat exchanger ENG60, the compression space C of the Stirling cycle components.

For an engine this closed loop design also has the advantage of self-sustaining operation—a power input is not necessary at any stage (though clearly a heat input, such as by burning fuel, is required into the heat exchange assemblies).

It is noted that in order to have a completely balanced system it is necessary to have two complete cycles in the loop. For example if there are three Stirling cycle/transmitter components aligned coaxially then ignoring the exciter 110 and terminator 112 it is a completely balanced system. If these three units are formed into a loop such that they are coplanar they will not be balanced. For complete balance two sets of three Stirling/transmitter units are needed giving a minimum of six units. This hexagonal arrangement is therefore not suited to small engines where low cost and simplicity are important factors.

EXAMPLES

The invention described here can be implemented in a whole range of ways. A number of examples will be briefly described here demonstrate some of the possibilities. The emphasis will be on engine operation but it will be understood that the same principles allow similar operation for heat pumps and coolers.

Example 1

Figure 14:
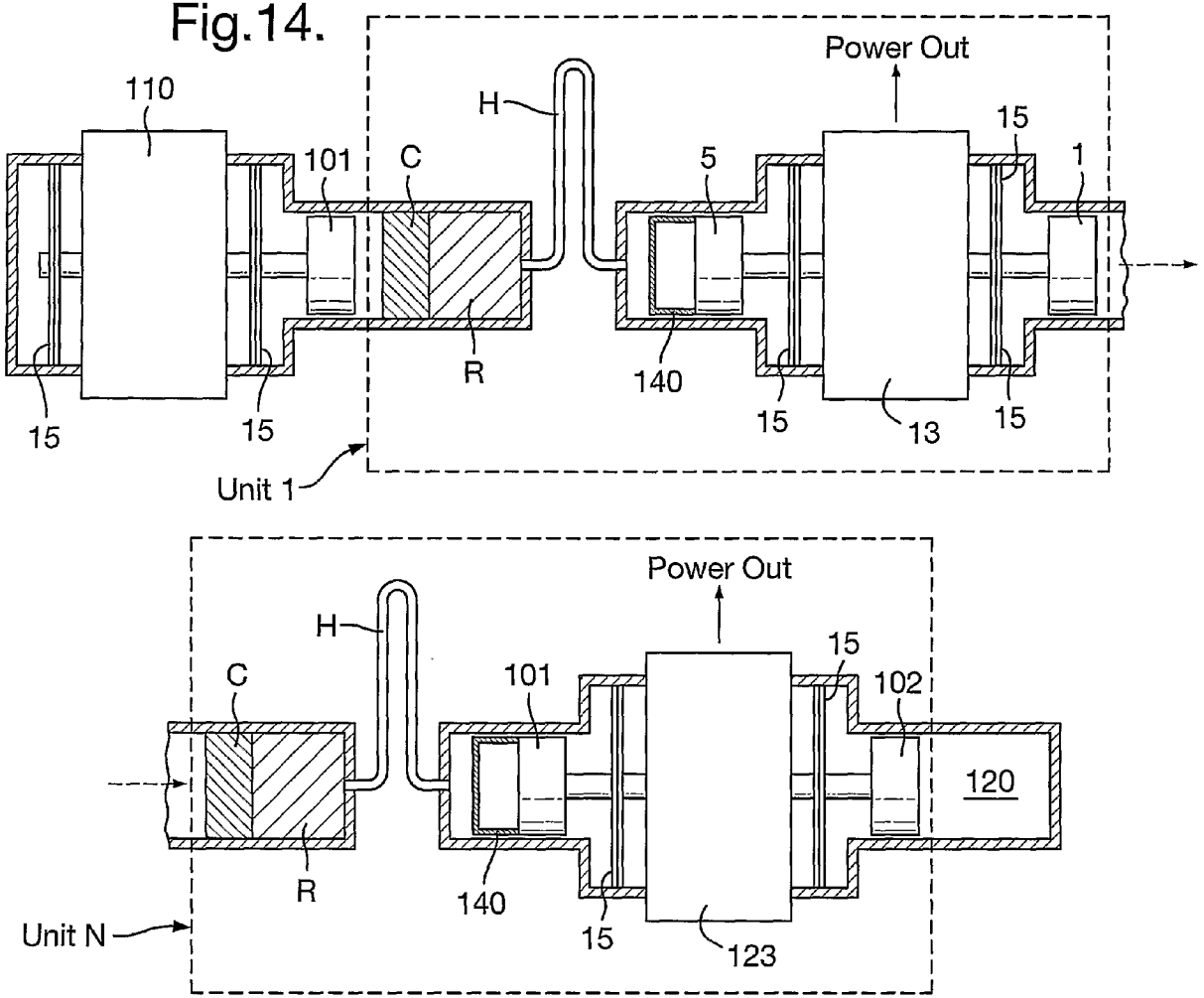

FIG. 14 shows in more detail an engine/generator configuration. Compressor unit 110 is used to initiate the sequence of Stirling units of which the first is Unit 1 and the last Unit N. The expander for terminating the sequence is integrated into the final transducer 123 and is provided with a gas spring volume 120 to achieve the correct dynamics. Each Unit includes a heat exchanger having a cooler C which can be a water-cooled tubular construction, a regenerator R e.g. of stacked stainless steel mesh, and a heater tube H such as an extended tubular construction for direct flame heating or heating via sodium heat-pipe.

Figure 15:
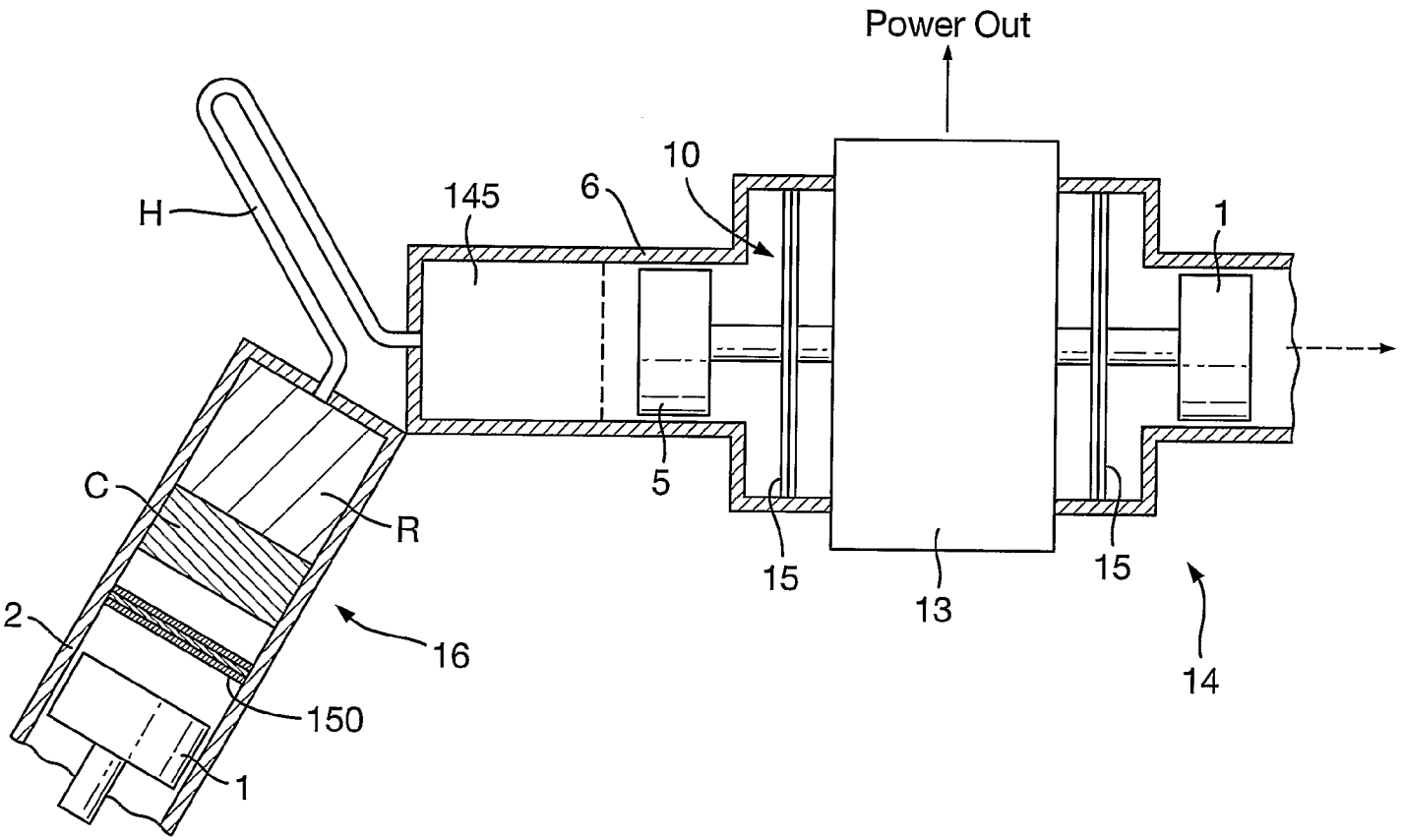

The cooler C and transmitter 13 both operate at roughly ambient temperature so there is no need to provide a thermal insulation between them. The heater H operates at a high temperature so it is necessary to provide a heat break between the heater H and the transmitter 13. In FIG. 14 a heat insulating extension 140 to the expansion piston 5 is shown. Another option that can be used as well is a thermal buffer tube 145 as is shown in FIG. 15.

The transmitter 13 can use one of a number of linear transducer/compressor designs such as those shown in U.S. Pat. No. 6,127,750 and U.S. Pat. No. 7,247,957.

There are a number of ways of achieving good balance but typically the transmitter units 13 can be aligned to be coaxial.

A preferred embodiment has units arranged in sets of three operating so as to give three-phase outputs. This can be achieved by having a 60 or 120 degree phase angle between the compression and expansion spaces. For the 120 degree volume phase angle it will be necessary to invert one of the transducer outputs to obtain three 120 degree electrical outputs. Several sets may be connected together so that there may be 3, 6, 9 and so on, units in total controlled by a single initiating compressor 110 and giving a combined three phase output.

The advantage of this arrangement for large installations can be demonstrated by considering how the compressor/expander loss varies as a proportion of the total power output. Making the following assumptions The expansion power $W_e$ is twice the compression power $W_c$: $W_e=2W_c$ The motor and generator efficiencies are equal to $\eta$ The total number of units is N The net power developed per unit is $$W_n=W_e-W_c=W_c$$

The total power output from the generators 13 will be $$W_{out}=\eta\cdot N\cdot W_c$$

The power lost in the initiating and terminating components 110, 112 is $$W_{loss}=(1-\eta^2)\cdot W_c$$

The ratio of loss to net output is given by $$R_{loss}+W_{loss}/W_{out}=(1-\eta^2)\cdot W_c/\eta\cdot N\cdot W_c=(1-\eta^2)/\eta\cdot N$$

For a small machine let N=3 and $\eta$=0.8, $R_{loss}$~0.15 i.e. 15%

For a larger machine let N=12 and $\eta$=0.95, $R_{loss}$~0.086 i.e. 0.86%

The relative loss in the larger machine is nearly twenty times less and at 0.86% is quite acceptable.

Each set of three units will be perfectly balanced so overall the balance will generally be fairly good. The initiating compressor 110 and terminating expander 112 will not be balanced by themselves but an additional balancer can easily be used to correct this.

Example 2

FIG. 15 shows in more detail one unit of the six incorporated in the closed-loop arrangement self-sustaining three phase engine/generator shown in FIG. 13. The general construction of this preferred embodiment will be similar to the engine described in example 1.

In a closed loop arrangement it is necessary to incorporate the changes of direction without detriment to operating efficiency. In a Stirling engine the heater H often has an extended tubular construction and this type of heat exchanger provides a convenient way connecting the six units 131 to 136 together to form the complete hexagonal arrangement.

The heater H also needs to be thermally insulated from the power transmitter 13 and in this example this is achieved through the use of a thermal buffer tube 145 as is shown in FIG. 15.

The use of the heater tubes H as connectors allows a modular construction for the Stirling machine, either in open series or closed loop configuration. Thus each module consists of the following components, in order, already assembled together: the expansion cylinder 6 housing its expansion piston 5, the moving assembly 10, including the linear power transmitter 13, in its housing 14, the compression cylinder 2 housing the compression piston 1 and the cooler C and regenerator R in their housing 16 (which can be integral with compression cylinder 2). These pre-assembled modules can be connected together easily in a chain by heater tubes H supplied with their ends in a variety of orientations to allow the modules to be connected coaxially for a straight chain (open series) or at various angles to form loops of different numbers of modules. Of course the modules can also be supplied with their components disassembled.

Figure 20:
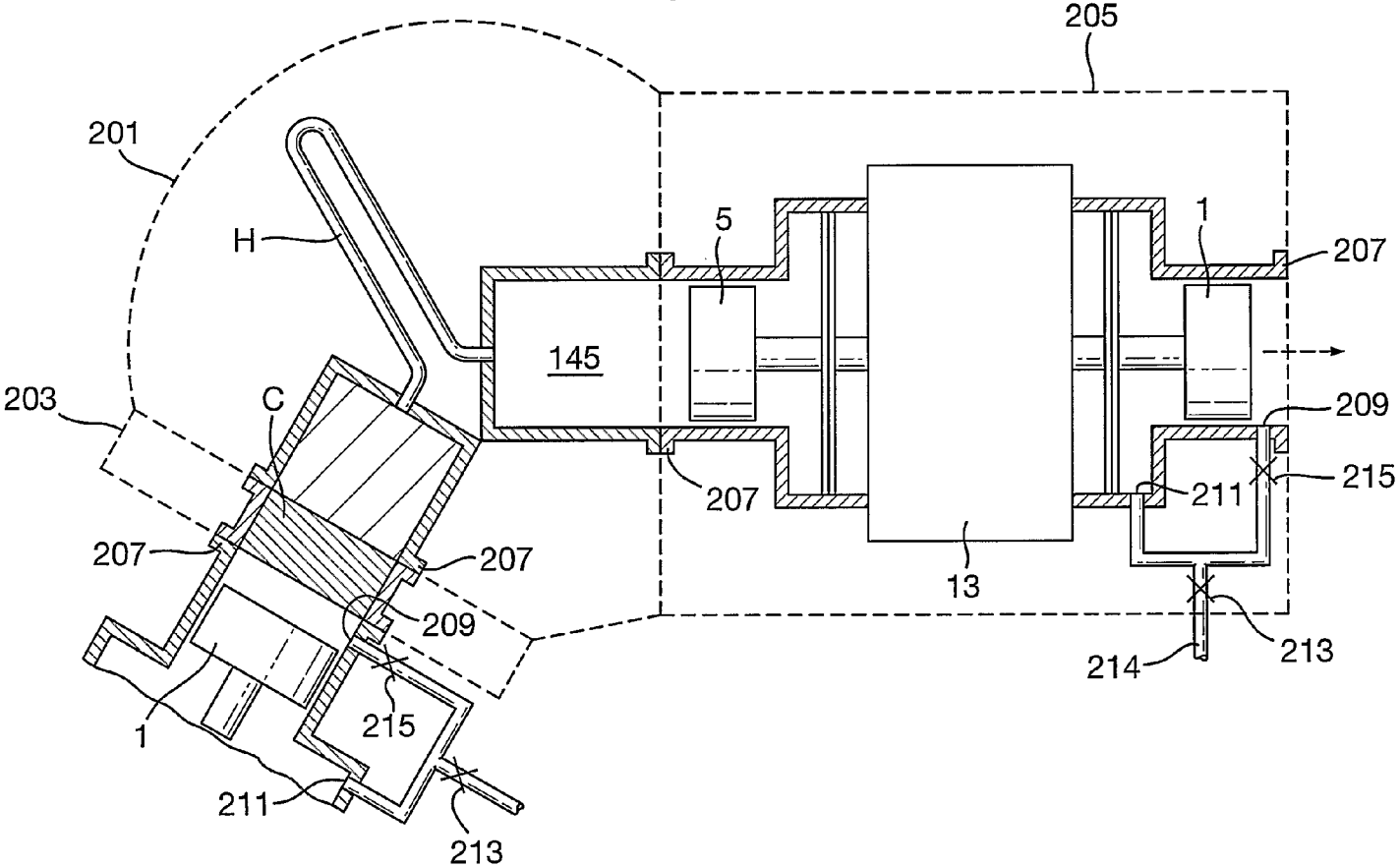

In a typical Stirling engine the heater tubes may be at a temperature of ~700 deg C and it is undesirable to have joints at this temperature because flanges have to be more massive; bolts and seals are more specialized and expensive. For a modular Stirling engine therefore the heater module is likely to include the any components that are subject to the high temperature. This is illustrated in FIG. 20 where a hot end module 201 includes the heater H, the regenerator R and the thermal buffer volume 145. The remaining modules are the cooler module 203 and the transmitter module 205. All the modules may be connected to each other at ambient temperature by means of conventional flanged joints 207 as indicated in FIG. 20.

Having connected the modules together using the heater tubes H, the system is pressurised with working fluid, e.g. helium, via one or more ports 209, 211 and a system valve 213 as is shown in FIG. 20. Although it is not essential, it is desirable to be able to bypass the piston seals during the processes of filling and releasing the system gas. This can be achieved by having a valve 215 connecting the working space to the fill line 214 as is shown in FIG. 20. To avoid having too much extra dead volume the valve 215 is situated as close to the working volume as possible.

If a valve is used that has a fast response then it is also possible to use it to control the mean pressure in the working volume (and hence offset) during engine operation. If the valve is opened whilst the cycle pressure is high the gas will flow out of the working volume and vice versa. The power input/output leads for the linear power transmitter 13 are connected, and the heating (e.g. from a burner) and, if necessary, cooling, connections are made to the heat exchanger C and heater tubes H.

A problem with self-sustaining engines of this sort is the control of power and the need to prevent damage from over-stroking in the event of load reduction. Various ways have been proposed for achieving this in the electrical load but they do not avoid the problem of severe over-stroking if the generator 13 itself fails. In a large machine this could have serious consequences and the only real option has been to rapidly depressurise the system.

The open nature of the engine described here allows a different approach which could not easily be used in previous designs. The basic need is to have some mechanism in the engine where by a significant loss can be varied to control the engine power. It is important that the loss that the mechanism introduces can be reduced to a low value for normal operation so that efficiency is not badly affected. The method shown in FIG. 15 is to introduce what could be termed an exergy throttle 150 between the piston 1 and the heat exchange assembly C,R,H. The throttle 150 is a mechanical device that varies the flow area for working fluid such that when it is open the gas velocities are small and when it is closed the gas velocities are high and give a significant loss.

Figure 16:
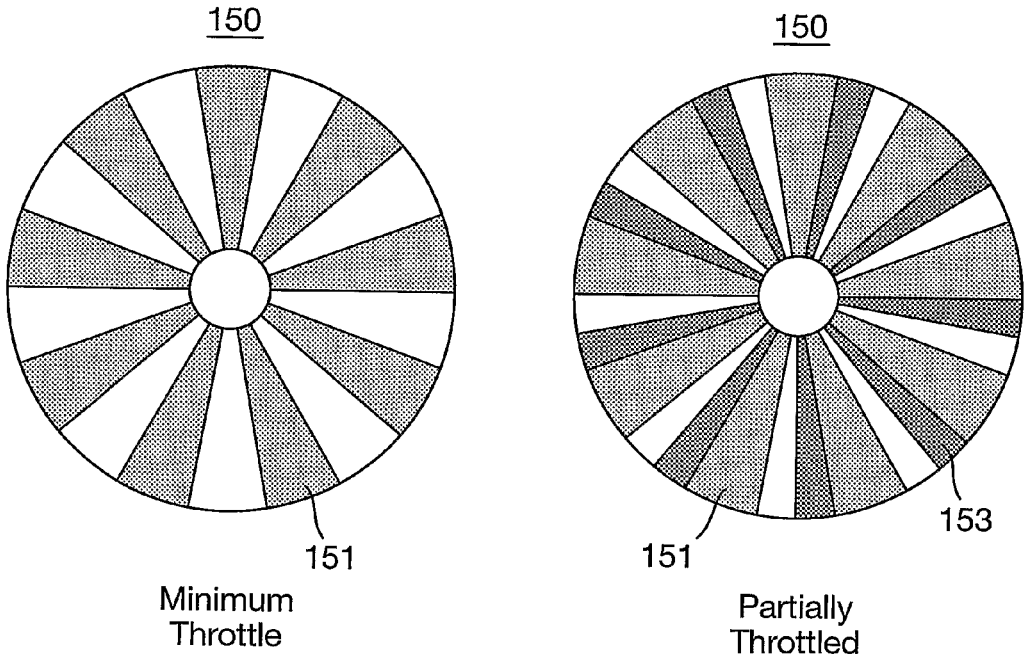

A conventional butterfly valve is one possibility but takes up significant axial volume. Another design is shown in FIGS. 16 and 17. FIG. 16 shows an end view of the throttle 150. It consists of two sets of radially disposed vanes arranged like petals with spaces between them defining a fluid flow area. One set 151 is fixed and the other set 153 can be rotated about a common axis. With the two sets of vanes aligned there is a maximum flow area and minimum loss. As the movable vane set 153 is rotated the flow area progressively decreases and the losses due to irreversible processes such as flow friction and mixing increase, and also the fluid flow and thus enthalpy flow is reduced. It can be arranged such that when the flow area is a minimum the engine will reciprocate with a small stroke at no load. One advantage of using this throttle 150 as a control is that the flow loss is proportional to the square of the velocity and hence is non-linear. The loss will always increase faster than the power produced and this will help stabilise the engine's operation.

Figure 17A:
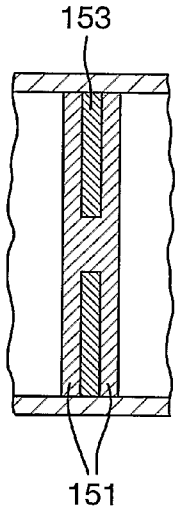
Figure 17B:
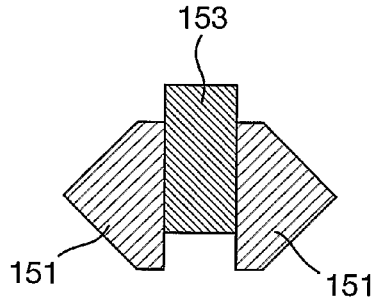

FIG. 17(A) gives more detail of the vanes and shows how the fixed vanes 151 can be split axially to lie in front of and behind the fixed vanes 153. As shown in FIG. 17(B) the fixed vanes 151 can also be shaped, e.g. streamlined, to smooth the flow past them to minimise flow losses in the open position.

The preferred site for the exergy throttle 150 will generally be in the compression space C as the temperature gradient is small and any additional mixing of the gas will not create an extra heat leak.

Example 3

Figure 18:
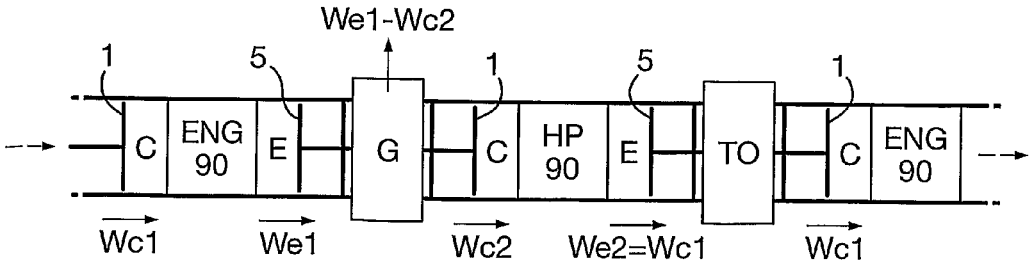

FIG. 18 shows an arrangement where different types of Stirling cycle unit are combined into single system. The Stirling cycle units are alternately engine units and heat pump units. The engine units produce enough power to drive the next heat pump unit and to output electrical power via generators G. The heat pumps use net power to pump heat in the heat exchange assembly denoted HP90. The expansion power of the heat pump is sufficient to drive the next engine unit—the transmitter denoted TO only transmits this power to the next engine compressor—there is no electrical power output from this transmitter.

As an example assuming that the compression power required by the engine units is Wc1=400 W to give an expansion power of We1=800 W and that the compression power for the heat pump is Wc2=600 W for an expansion power of We2=400 W. It can then be seen that the net power developed by the Stirling engine components can be efficiently used to both generate electricity (200 W) and also drive a heat pump. A similar arrangement could be used for providing cooling by replacing the heat pump with a refrigerator.

It is noted that in this arrangement two different transmitter units 13 are used that will transfer different amounts of power and which will also have different dynamics in order to achieve the required phase relationships. The two transmitters can have different strokes so the heat pump compressor piston does not necessarily have to have a larger diameter than its corresponding expansion piston in order to fulfil the condition:

$$V_{cd}/T_c > V_{ed}/T_e$$

Example 4

Figure 19:
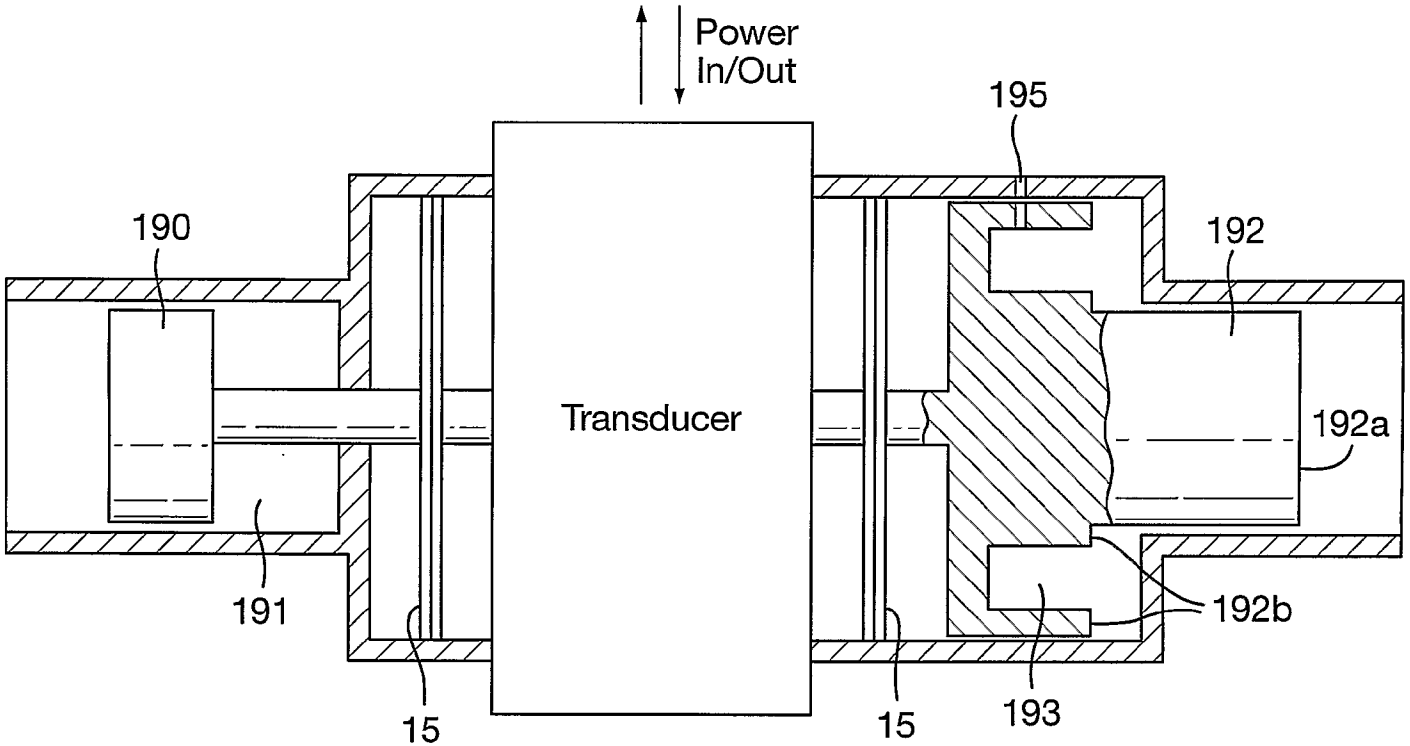

It was shown above that for the required phase relationships the resonant frequency of the transmitter assembly 13 had to have a certain value depending on the intended operating frequency. In larger machines it generally proves more difficult to provide sufficient spring rate using flexures alone. One method for increasing the spring rate is to incorporate gas springs into the transmitter assembly 13. This requires additional piston/cylinder components. FIG. 19 shows two ways in which this can be done. One way is to adapt piston assembly 190 so that whilst the one side acts as a compression or expansion piston for a Stirling cycle unit, the other side acts on a simple gas volume 191 and behaves as a gas spring.

The other way to provide additional spring rate is to use a stepped piston 192. The inner piston area 192*a* acts as a compression or expansion piston for a Stirling cycle unit while the outer area 192*b* acts on a simple gas volume 193 and behaves as a gas spring.

The stepped piston in FIG. 19 also shows the use of a port 195 for controlling offset. The port 195 fixes the gas pressure at the mid-stroke. Variation of this pressure controls the mean gas pressure in the gas spring 193 and hence the mean force.

Example 5

Figure 21A:
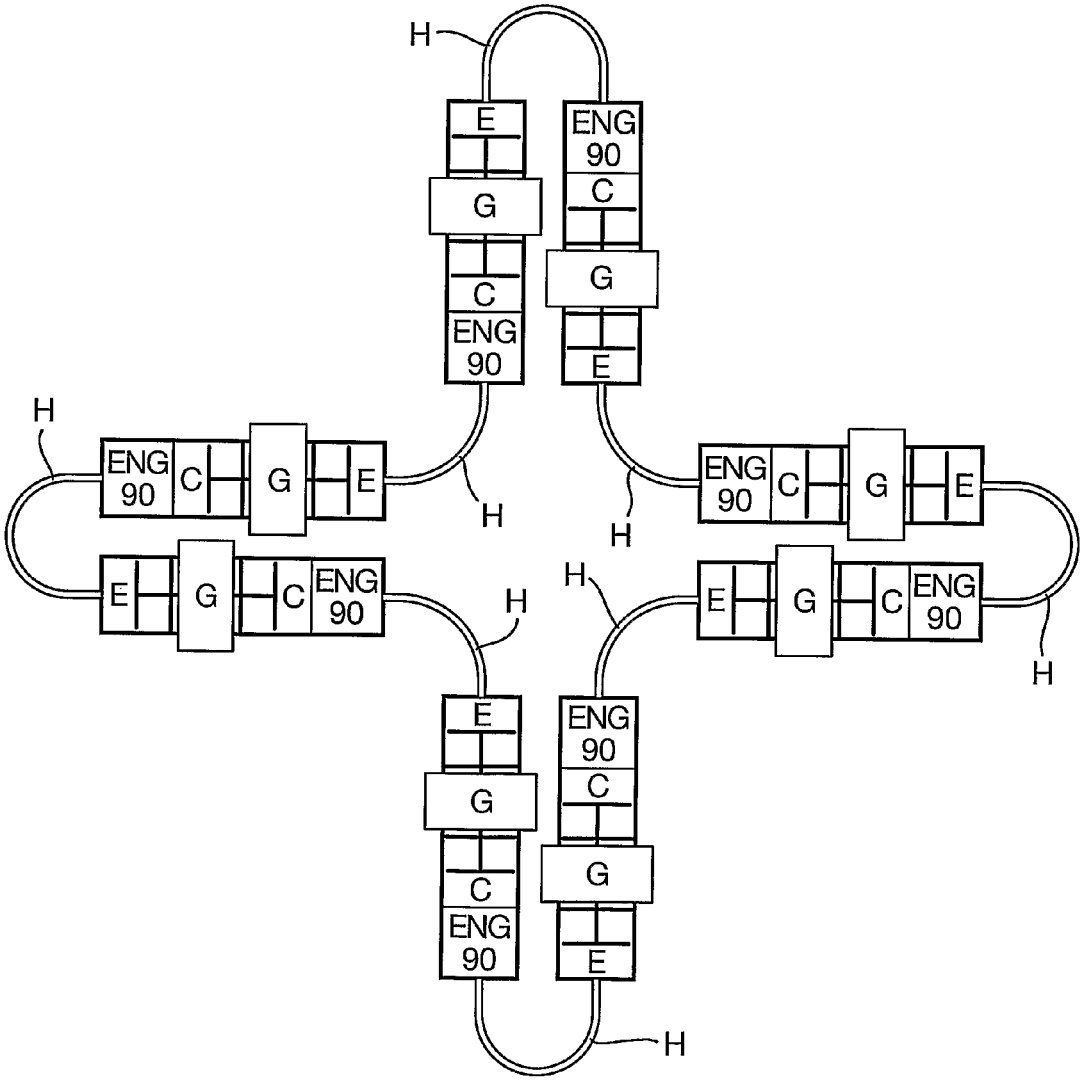
FIG. 21A shows schematically an arrangement for eight Stirling cycle units in accordance with another embodiment of the invention.

FIGS. 21A and B show other closed loop arrangements which are also coplanar but in which pairs of Stirling units are arranged radially. FIG. 21A shows an engine arrangement for eight units but it is also possible to have other even numbered combinations. This arrangement will generate electrical power from the eight generators G in response to heat being applied to the heater tubes H in the centre and around the periphery. Heat is rejected from the compression spaces through the use of corresponding conventional water cooled heat exchangers (not shown).

While FIG. 21A is a possible arrangement for an engine it is not attractive to have two different heater assemblies. This configuration however is attractive in applications where engine and heat pump units are combined, as in example 3, as it naturally separates the two alternate types of heat exchanger assemblies.

Figure 21B:
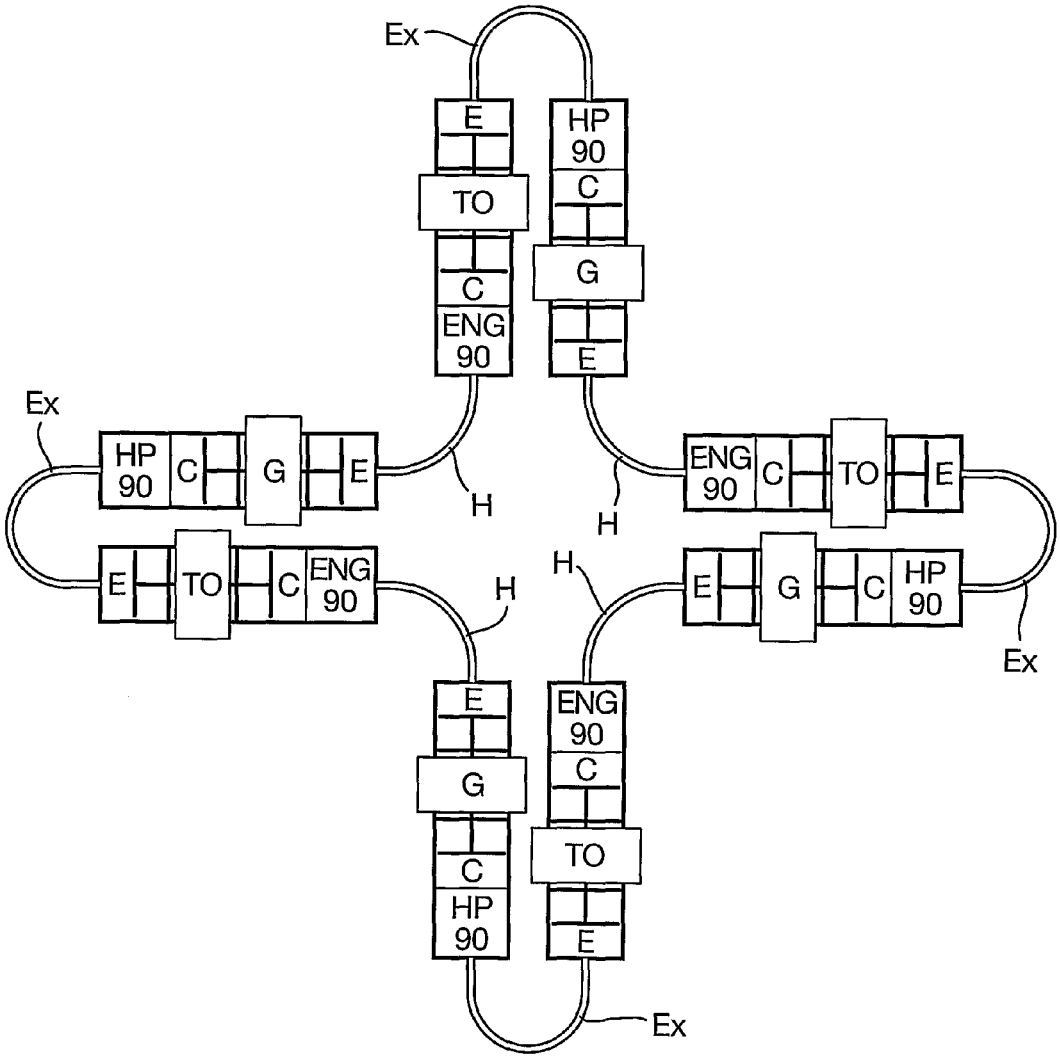
FIG. 21B shows schematically a further arrangement for eight Stirling cycle units in accordance with another embodiment of the invention.

In FIG. 21B the Stirling units with the expansion heat exchangers Ex at the periphery are refrigeration units labelled HP (for heat pump). Their corresponding transmitters are labelled TO (for transmission only) as they do not output any power, they only transmit the expansion space work of the heat pumps to the compression space of the adjacent engine. The expansion space heat exchangers Ex for the refrigeration units are equivalent to the evaporators in a conventional two phase refrigerator. The central heat exchangers are heaters for Stirling engine units and so can be heated by a single burner. The remaining transmitters are generators for the engines that output surplus power not required by the heat pump cycles. Heat is rejected from all the compression spaces through the use of corresponding conventional water cooled heat exchangers (again not shown).

Example 6

Figure 22A:
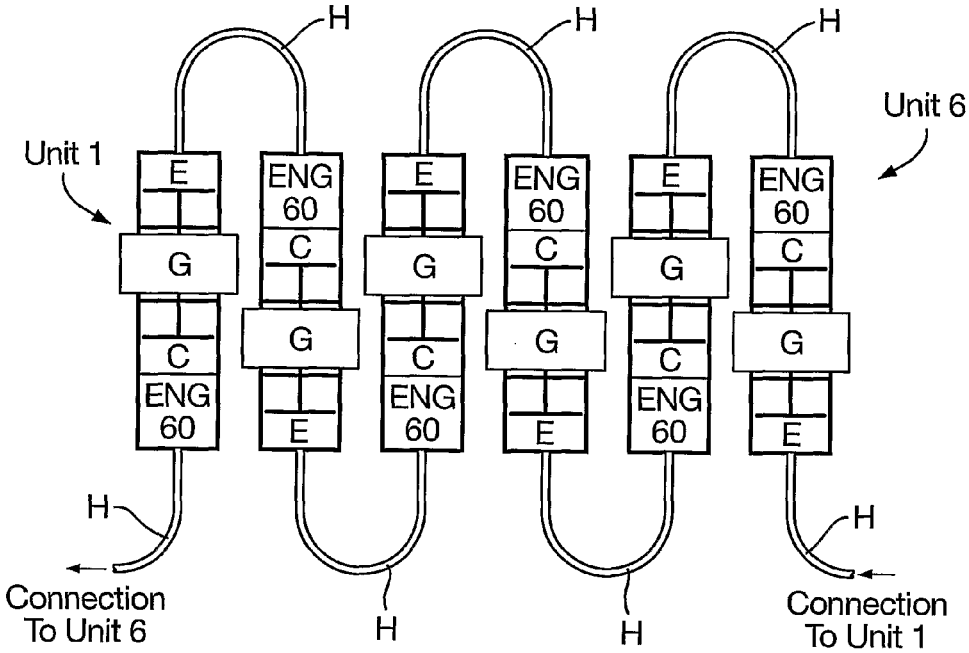
FIG. 22A illustrates schematically a six cylinder Stirling cycle unit arrangement in accordance with another embodiment of the invention by showing a two-dimensional representation where the units have been unwound.
Figure 22B:
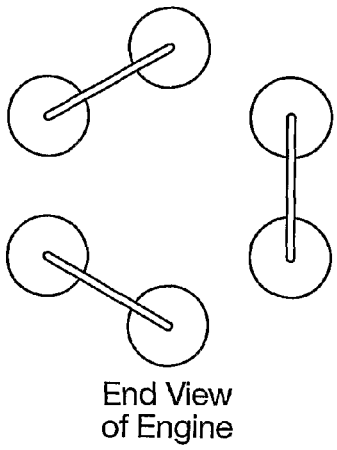
FIG. 22B is a schematic end view of the FIG. 22B arrangement.

Another closed loop arrangement is possible in which the Stirling units are aligned along a common axis with heater tubes H making the necessary connection between the units at both ends. FIG. 22A illustrates this arrangement by showing a two-dimensional representation where the units have been unwound. FIG. 22B is an end view showing the cylindrical geometry. The units do not have to be symmetrically disposed around a cylinder but this arrangement has the advantage of requiring only one geometry for the heater tubes assembly.

It is noted that in the above examples, reference has been made to extended tubular heat exchangers and the ability to accommodate curvature within an expansion space heat exchanger. A wide range of alternative heat exchanger geometries is possible for all the heat exchangers as is known to someone skilled in the art. Also curvature may be accommodated in the compression or regenerator heat exchangers although this may not be preferred.

What is claimed is:

1. A linear, multi-cylinder Stirling cycle machine comprising three or more Stirling cycle units connected together in series with each other, each of said units comprising a compression space in fluid communication with an expansion space via a heat exchange assembly, said compression space and expansion space also being in fluid communication with, respectively, a compression piston and an expansion piston, and wherein each of said units is mechanically coupled to another of said units by a linear power transmitter, each of said linear power transmitters connecting the expansion piston of a single one of said units to the compression piston of a single one of another of said units.

2. A machine according to claim 1 wherein the heat exchange assembly comprises a series connection of a first heat exchanger, a regenerator and a second heat exchanger.

3. A machine according to claim 1, wherein the linear power transmitter is a linear power transducer.

4. A machine according to claim 1 wherein the Stirling cycle units are connected together in an open series configuration with a compressor initiator at one end connected to the compression space of the first unit in the series and an expander terminator at the other end connected to the expansion space of the last unit in the series.

5. A machine according to claim 1 wherein the Stirling cycle units are connected together in a closed loop comprising three or more units with the expansion piston of each unit being connected to the compression piston of the next unit of the loop via said linear power transmitter.

6. A machine according to claim 1 wherein the compression and expansion spaces are cylindrical.

7. A machine according to claim 1 wherein the axis of each connection between the heat exchange assembly and the compression and expansion spaces is aligned with the axis of the respective compression or expansion piston.

8. A combined heat and power apparatus comprising a linear, multi-cylinder Stirling cycle machine according to claim 1, at least one of said Stirling cycle units acting as an electricity generator, whereby heat supplied to said heat exchange assembly is used to produce electricity, and surplus heat is output for heating.

9. A set of modules for assembling into a machine according to claim 1, wherein the modules comprise a hot end module comprising a hot end heat exchanger connected between a thermal regenerator and a thermal buffer, a cooler module comprising a cold end heat exchanger, and a transmitter module comprising a moving assembly of expansion and compression pistons and a linear power transmitter, whereby the joints between the modules are at relatively low temperature parts of the machine.

10. A machine according to claim 1 wherein said three or more Stirling cycle units includes a first Stirling cycle unit, a second Stirling cycle unit, and a third Stirling cycle unit, and wherein the first Stirling cycle unit is mechanically coupled to the second Stirling cycle unit by a first linear power transmitter, and the second Stirling cycle unit is mechanically coupled to the third Stirling cycle unit by a second linear power transmitter.

11. A machine according to claim 2 wherein the first heat exchanger is a low temperature heat exchanger and the second heat exchanger is a high temperature heat exchanger.

12. A machine according to claim 2 wherein at least the regenerator and one of the heat exchangers has a cylindrical form.

13. A machine according to claim 3 wherein the power transducer is adapted to receive a power input to the machine and the heat exchange assembly operates as a heat pump or cooler.

14. A machine according to claim 3 wherein the heat exchange assembly absorbs heat and the linear power transducer outputs power from the machine.

15. A machine according to claim 3, wherein the linear power transducer is an electromechanical transducer.

16. A machine according to claim 15 wherein the electromechanical transducer is a linear motor or generator.

17. A machine according to claim 4 wherein the exciter compressor controls the operating frequency and power of the machine.

18. A machine according to claim 4 wherein the Stirling cycle units are arranged coaxially.

19. A machine according to claim 5 wherein the Stirling cycle units are disposed with their axes coplanar.

20. A machine according to claim 5 wherein a throttle is included in one of the Stirling cycle units to control the power of the machine.

21. A machine according to claim 20 wherein the throttle has an array of radially-extending fixed petals mutually spaced to allow fluid flow between them and arranged coaxially therewith an array of radially-extending spaced movable petals disposed such that axial rotation of the movable and fixed petals selectively varies the fluid flow space between the fixed petals.

22. A combined heat and power apparatus according to claim 8 wherein one of said Stirling cycle units acts as a heat pump or cooler.

23. An apparatus according to claim 8 wherein said three or more Stirling cycle units includes a first Stirling cycle unit, a second Stirling cycle unit, and a third Stirling cycle unit, and wherein the first Stirling cycle unit is mechanically coupled to the second Stirling cycle unit by a first linear power transmitter, and the second Stirling cycle unit is mechanically coupled to the third Stirling cycle unit by a second linear power transmitter.

* * * * *